US006680717B2

(12) United States Patent
Tanaka

(10) Patent No.: US 6,680,717 B2
(45) Date of Patent: Jan. 20, 2004

(54) DRIVING METHOD OF PLASMA DISPLAY PANEL

(75) Inventor: Yoshito Tanaka, Tokyo (JP)

(73) Assignee: NEC Corporation, Tokyo (JP)

( * ) Notice: Subject to any disclaimer, the term of this patent is extended or adjusted under 35 U.S.C. 154(b) by 9 days.

(21) Appl. No.: 09/983,954

(22) Filed: Oct. 26, 2001

(65) Prior Publication Data

US 2002/0171609 A1 Nov. 21, 2002

(30) Foreign Application Priority Data

Oct. 26, 2000 (JP) ..... 2000-327105

(51) Int. Cl.[7] ..... G09G 3/28
(52) U.S. Cl. ..... 345/60; 345/67
(58) Field of Search ..... 345/60, 66, 67, 345/68; 315/169.1

(56) References Cited

U.S. PATENT DOCUMENTS 5,854,540 A * 12/1998 Matsumoto et al. ..... 315/169.1
5,874,932 A * 2/1999 Nagaoka et al. ..... 345/60
6,054,970 A * 4/2000 Hirakawa et al. ..... 345/60
6,320,560 B1 * 11/2001 Sasaki et al. ..... 345/60
6,456,263 B1 * 9/2002 Hashimoto et al. ..... 345/60
6,512,500 B2 * 1/2003 Sasaki et al. ..... 345/60
2002/0030643 A1 * 3/2002 Sasaki et al. ..... 345/60
2002/0167468 A1 * 11/2002 Hashimoto et al. ..... 345/60

* cited by examiner

*Primary Examiner*—Amare Mengistu
(74) *Attorney, Agent, or Firm*—Young & Thompson

(57) ABSTRACT

In a plasma display panel driving method, during a selection period B, the potential of sustain electrodes 3 are fixed to a first auxiliary scan voltage Vnsw once. Thereafter, in the sustain electrode 3*i* corresponding to an (i)th scan electrode 2*i* in the scanning order for applying the scan pulse Vw, the sustain electrode potential is sequentially changed to a second auxiliary scan voltage Vpsw at a timing which is later than the application of the (i)th scan pulse Vwi by a half of the pulse width of the (i)th scan pulse Vwi. The first auxiliary scan voltage Vnsw is a voltage which never generates a surface electric discharge between the scan electrode 2.

18 Claims, 16 Drawing Sheets

DRIVING METHOD OF PLASMA DISPLAY PANEL

BACKGROUND OF THE INVENTION

The present invention relates to a driving method of a plasma display panel, and more specifically to a driving method of a plasma display panel of an alternate current discharge type and a matrix display scheme.

A first example of a conventional plasma display panel and a method for driving the same will be described with reference to the drawings. FIG. 12 is a partial sectional view of the conventional plasma display panel. The conventional plasma display panel includes two insulating substrates 1*a* and 1*b* formed of glass and constituting a front plate and a back plate.

On the insulating substrate 1*a*, transparent scan electrodes 2 and sustain electrodes 3 are formed, and trace electrodes 4 are formed to lay over the scan electrodes 2 and the sustain electrodes 3 to reduce a resistance value of these electrodes. In addition, a first dielectric layer 9 is formed to cover the scan electrodes 2 and the sustain electrodes 3. Furthermore, a protection layer 10 of magnesium oxide or another is formed to protect the dielectric layer 9 from an electric discharge.

On the insulating substrate 1*b*, data electrodes 5 are formed to extend orthogonally to the scan electrodes 2 and the sustain electrodes 3. A second dielectric layer 11 is formed to cover the data electrodes 5. On the second dielectric layer 11, a partition 7 is formed to extend in the same direction as that of the data electrode and to confine display cells which are a unit of display. Furthermore, a phosphor layer 8, which converts a ultraviolet radiation generated by an electric discharge in an electric discharge gas, to a visible light, is formed on a side surface of the partition 7 and on a surface of the dielectric layer 11 on which the partition 7 is not formed.

Furthermore, a space sandwiched between the insulating substrates 1*a* and 1*b* and confined by the partition 7 constitutes an electric discharge space filled up with an electric discharge gas which is formed of helium, neon, xenon and a mixed gas of those gases.

In the plasma display panel constituted as mentioned above, a surface electric discharge 100 is generated between the scan electrode 2 and the sustain electrode 3.

FIG. 13 is a diagram of illustrating an electrode location in the conventional plasma display panel. One display cell 12 is formed on each intersection between one scan electrode 2 and one sustain electrode 3 and one data electrode 5 extending orthogonally to these electrodes. The scan electrodes 2 are individually connected to a scan driver integrated circuit (IC) 21 so that a scan voltage pulse is individually applied to each scan electrode. All the sustain electrodes 3 are electrically connected in common to a sustain circuit 22 at a panel end or on a driving circuit, so that only a common waveform is applied to the sustain electrodes. In addition, the data electrodes 5 are connected to a data driver integrated circuit (IC) 23 so that a data pulse can be individually applied to each data electrode.

Now, various selective display operations of the display cell will be described. FIG. 14 is a timing chart for illustrating voltage pulses applied to various electrodes in a first conventional driving method. In addition, FIG. 15 is a diagram for illustrating a wall electric charge within the display cell during a selection period B in the first conventional driving method. In FIG. 14, a period A is a preliminary electric discharge period for facilitating generation of an electric discharge in a succeeding selection period, and a period B is a selection period for on-off selecting the luminescence of each display cell. A period C is a sustain period for causing an illuminant electric discharge in all the selected display cells, and a period D is a sustain extinguishing period for extinguishing the illuminant electric discharge. Here, in this first conventional driving method, a reference potential of a surface electrode composed of the scan electrodes 2 and the sustain electrodes 3 is a sustain voltage Vos for sustaining the electric discharge during the sustain period C. Therefore, in connection with the scan electrode 2 and the sustain electrode 3, a potential higher than the sustain voltage Vos is called to have a positive polarity, and a potential lower than the sustain voltage Vos is called to have a negative polarity. In addition, in connection with the potential of the data electrode 5, 0V is considered to be a reference.

First, in the preliminary electric discharge period A, a positive sawtooth preliminary electric discharge pulse Vops is applied to the scan electrodes 2, and simultaneously, a negative rectangular preliminary pulse Vopc is applied to the sustain electrode 3. The pulse-height value of these preliminary electric discharge pulses is set to exceed an electric discharge starting threshold value between the scan electrode 2 and the sustain electrode 3. Accordingly, when the preliminary electric discharge pulses Vops and Vopc are applied to the corresponding electrodes, the voltage of the sawtooth preliminary electric discharge pulse Vops increases, and after a voltage between both the electrodes exceeds the electric discharge starting threshold value, a weak electric discharge occurs between the scan electrode 2 and the sustain electrode 3. As a result, a negative wall electric charge is formed on the scan electrode 2, and a positive wall electric charge is formed on the sustain electrode 3.

Succeeding to the preliminary electric discharge pulses Vops, a negative sawtooth preliminary electric discharge extinguishing pulse Vope is applied to the scan electrode 2. At this time, the potential of the sustain electrode 3 is fixed to the sustain voltage Vos. With application of the preliminary electric discharge extinguishing pulse Vope, the wall electric charge formed on the scan electrode 2 and the sustain electrode 3 is extinguished. Here, even after the wall electric charge is extinguished, space-charges such as electrons and ions and active particles such as quasi-stable particles generated in the preliminary electric discharge exists in the electric discharge space 6, even if those are a little amount. In addition, the extinction of the wall electric charge during the preliminary electric discharge period A includes adjustment of the wall electric charge in order to cause the succeeding operations such as the selection operation and the sustain electric discharge to be carried out in a good condition.

In the selection period B, after all the scan electrodes 2 are maintained at a base potential Vobw once, a negative scan pulse Vow is sequentially applied to each scan electrode 2, and a data pulse Vod corresponding to a display data is individually applied to each data electrode 5. During this period, a positive auxiliary scan pulse Vosw is applied to the sustain electrode 3. Here, the scan pulse Vow and the data pulse Vod are set to ensure that a voltage difference between confronting electrodes constituted of the scan electrode 2 and the data electrode 5 never exceeds the electric discharge starting threshold voltage when only either one of the scan pulse Vow and the data pulse Vod is applied, but exceeds the electric discharge starting threshold voltage when both the scan pulse Vow and the data pulse Vod are superposed. On the other hand, the auxiliary scan pulse Vosw is set to ensure that when the auxiliary scan pulse Vosw is superposed with the scan pulse Vow, a voltage difference between surface electrodes constituted of the scan electrode 2 and the sustain electrode 3 never exceeds an electric discharge starting threshold voltage between the surface electrodes.

Accordingly, in only the display cell applied with the data pulse Vod in time with application of the scan pulse Vow, a space electric discharge (generated between confronting electrodes) occurs between the scan electrode 2 and the data electrode 5 as shown in FIG. 15. At this time, since a voltage difference occurs between the scan electrode 2 and the sustain electrode 3 because of the scan pulse Vow and the auxiliary scan pulse Vosw applied thereto respectively, an electric discharge is triggered by the space electric discharge and is generated between the scan electrode 2 and the sustain electrode 3. This electric discharge becomes a writing electric discharge. Because a small amount of space electric charges and active particles exist in the electric discharge space 6 for the electric discharge and the extinction of the wall electric charge during the preliminary electric discharge period A, this writing electric discharge is stably generated with an electric discharge probability depending upon the amount of the existing electric charges and active particles. As a result, as shown in FIG. 15, in the selected display cell 12, a positive wall electric charge is formed on the scan electrode 2 and a negative wall electric charge is formed on the sustain electrode 3.

Thereafter, in the sustain period C, phase-inverted sustain pulses Vosp having the same pulse-height value as that of the sustain voltage Vos are supplied to all the scan electrodes 2 and all the sustain electrodes 3, respectively. The sustain voltage Vos is set to ensure that when the sustain voltage Vos is superposed on the wall voltage formed on the surface electrodes by the writing electric discharge in the selection period B, an electric discharge is generated, but when the sustain voltage Vos is not superposed on the wall voltage, no electric discharge is generated because a voltage between the surface electrodes does not exceed the electric discharge starting threshold voltage. Accordingly, the sustain electric discharge for the luminescence is generated in only the display cells having the wall electric charge formed by the writing electric discharge generated in the selection period B.

In the succeeding sustain extinguishing period D, the voltage of the sustain electrodes 3 are fixed to the sustain voltage Vos, and a negative sawtooth sustain extinguishing pulse Voe is applied to the scan electrodes 2. In this process, the wall electric charge on the surface electrodes is extinguished so that it is returned into an initial condition, namely, a condition before the preliminary electric discharge pulses Vops and Vopc are applied in the preliminary electric discharge period A. Incidentally, the extinction of the wall electric charge during the sustain extinguishing period D includes adjustment of the wall electric charge in order to cause the succeeding operations to be carried out in a good condition.

In an actual driving method for the plasma display panel, one sub-field is constituted of the preliminary electric discharge period A or the selection period B to the sustain extinguishing period D, and one field is constituted by combining a plurality of sub-fields obtained by changing the number of the sustain pulses Vosp in the sustain period C. A display luminance is adjusted by on-off selection of the respective sub-fields.

Now, a second conventional driving method will be described. FIG. 16 is a timing chart for illustrating voltage pulses applied to various electrodes in the second conventional driving method. FIGS. 17*a* and 17*b* are diagrams for illustrating a wall electric charge within the display cell in the second conventional driving method. FIG. 17*a* illustrates the condition of the wall electric charge in a period F, and FIG. 17*b* illustrates the condition of the wall electric charge in a period G. In FIG. 16, a period E is a reset period for resetting a preceding electric discharge condition and facilitating generation of an electric discharge in a succeeding selection period, and a period F is a selection period for on-off selecting the luminescence of each display cell. A period G is an electric discharge converting period for converting a space electric discharge into a surface electric discharge in a cell in which a writing space electric discharge occurs in the selection period F, and a period H is a sustain period for sustaining the illuminant electric discharge in all the selected display cells.

First, in the reset period E, a positive preliminary electric discharge pulse Vo2*p* is applied to the sustain electrode 3, and simultaneously, a positive preliminary electric discharge pulse Vo2*pd* is applied to the data electrode 5. At this time, the potential of the scan electrode 2 is fixed to 0V. The pulse-height value of the preliminary electric discharge pulse Vo2*p* is set to be sufficiently higher than the electric discharge starting voltage between the scan electrode 2 and the sustain electrode 3. Accordingly, with application of the preliminary electric discharge pulses Vo2*pd* and Vo2*p*, an electric discharge occurs in all the display cells, regardless of existence/non-existence of the electric discharge in the preceding sub-field, so that a large amount of wall electric charge is formed on the surface electrodes. If the application of the preliminary electric discharge pulses Vo2*pd* and Vo2*p* is terminated, a secondary electric discharge occurs because of an internal voltage generated in the electric discharge space 6 by action of the large amount of wall electric charge formed on the surface electrodes. This secondary electric discharge becomes a self-extinguishing electric discharge which will not form a new wall electric charge, since no voltage difference is given between the scan electrode 2 and the sustain electrode 3 from an external. As a result, all the wall electric charge on the surface electrodes becomes extinguished.

Next, in the selection period F, a scan pulse Vo2*w* is sequentially applied to each scan electrode 2, and a data pulse Vo2*d* corresponding to a display data is individually applied to each data electrode 5. During this period, a negative auxiliary scan pulse Vo2*sw* is applied to the sustain electrodes 3. As a result, as shown in FIG. 17*a*, in only the display cell applied with the data pulse Vo2*d* in time with application of the scan pulse Vo2*w*, a space electric discharge (generated between confronting electrodes) occurs between the scan electrode 2 and the sustain electrode 5. At this time, since the negative auxiliary scan pulse Vo2*sw* having the same polarity as that of the scan pulse Vo2*w* is applied to the sustain electrodes 3, a voltage difference enough to generate a surface electric discharge does not exist between the scan electrode 2 and the sustain electrode 3, with the result that no surface electric discharge occurs. Consequentially, as shown in FIG. 17*a*, a positive wall electric charge is formed on the scan electrode 2, and a negative wall electric charge is formed on the data electrode 5. But, no wall electric charge is formed on the sustain electrode 3.

Thereafter, in the electric discharge converting period G, a negative electric discharge converting pulse Vo2*sd* is applied to the data electrodes 5, and simultaneously, a positive electric discharge converting pulse Vo2*ss* is applied to the scan electrodes 2, and furthermore, a negative electric discharge converting pulse Vo2*sc* is applied to the sustain electrodes 3. In the cell in which the space electric discharge has occurred in the selection period F, since a wall voltage based on the wall electric charge formed by the space electric discharge is superposed on the electric discharge converting pulses Vo2*sd* and Vo2*ss*, a space electric discharge occurs again between the data electrode 5 and the scan electrode 2 as shown in FIG. 17*b*. In addition, a surface electric discharge is triggered by the space electric discharge thus generated, and is generated between the scan electrode 2 and the sustain electrode 3. As a result, the wall electric charge is formed on the surface electrodes as shown in FIG. 17*b*.

In the succeeding sustain period H, phase-inverted sustain pulses Vosp are supplied to all the scan electrodes 2 and all the sustain electrodes 3, respectively. As a result, the sustain electric discharge for the luminescence is generated in only the display cells in which the electric discharge had occurred in the selection period F and the electric discharge converting period G.

This driving method is disclosed in for example Japanese Patent Application Pre-examination Publication No. JP-A-2000-172227.

However, in the first conventional driving method of the plasma display panel, the space electric discharge between the scan electrode 2 and the data electrode 5 and the surface electric discharge between the scan electrode 2 and the sustain electrode 3 substantially simultaneously occur in the selection period B. Therefore, a large current flows in the scan driver IC 21. In particular, when the electric discharge probability is extremely large because of a large amount of active particles existing in the display cell, the writing electric discharges substantially simultaneously occur in the display cells located on one scan electrode 2, so that a peak current attributable to the electric discharges becomes extremely large. Accordingly, a problem is encountered which requires an expensive scan driver IC having a large current capacity.

On the other hand, according to the second conventional driving method of the plasma display panel, in the selection period F, the space electric discharge occurs between the scan electrode 2 and the data electrode 5, but the surface electric discharge does not occur between the scan electrode 2 and the sustain electrode 3. Therefore, the current flowing through the scan driver IC 21 is reduced to about a half of that required in the first conventional driving method. However, the second conventional driving method is required to generate the space electric discharge using the data electrode 5 as a cathode in the electric discharge converting period G. In order to lower the electric discharge voltage in the plasma display panel, it is a general practice that, as the protection film 10 shown in FIG. 12, a film of a material such as magnesium oxide (MgO) having a high secondary electron emission coefficient is formed on an electrode functioning as a cathode, but such a material is not formed on the data electrode 5. Therefore, an extremely high voltage is required to generate the electric discharge.

In addition, as shown in FIG. 17*b*, when the space electric discharge is generated, since the data electrode 5 becomes the cathode, ionized electric discharge gas atoms flow into the data electrode 5 from the electric discharge space 6. As shown in FIG. 12, since the data electrode 5 is covered with the phosphor layer 8, the phosphor 8 is damaged by ions, so that luminance is deteriorated.

Furthermore, since the data electrode 5 is required to be applied with the positive pulse in the selection period F but to be applied with the negative pulse or bias in the electric discharge converting period G, the cost of the data driver IC 23 becomes increased.

BRIEF SUMMARY OF THE INVENTION

Accordingly, the present invention was made to overcome the above mentioned problems. An object of the present invention is to provide a driving method of a plasma display panel capable of reducing the cost of the drivers and others without giving an adverse influence to characteristics, such as the luminance deterioration.

The plasma display panel driving method in accordance with the present invention is a plasma display panel driving method for driving a plasma display panel of a matrix display scheme which includes first and second substrates located to oppose each other, a plurality of first electrodes provided on a surface of the first substrate opposing the second substrate and extending in parallel in a row direction, a plurality of second electrodes extending in parallel to the first electrodes, each of second electrodes being paired with a corresponding one of the first electrodes so that a display line is constituted by a gap between the first electrode and the second electrode adjacent to each other, a plurality of third electrodes provided on a surface of the second substrate opposing the first substrate and extending in a column direction extending orthogonally to an extending direction of the first and second electrodes, and one display cell provided at each intersection between the first and second electrodes and the third electrodes, wherein a display is controlled on the basis of whether or not an electric discharge had occurred between the first electrode and the third electrode during an addressing period, the plasma display panel driving method comprising, during said addressing period, the step of applying a voltage generating a space electric discharge, between the first electrode and the third electrode in the display cell to be displayed, while maintaining a potential of the second electrode at a first potential which does not generate a surface electric discharge between the first electrode and the second electrode, and the step of changing the potential of the second electrode in the display cell to be displayed, to a second potential which generates the surface electric discharge between the first electrode and the second electrode.

In the present invention, during the addressing period, the current peak of the space electric discharge and the current peak of the surface electric discharge are shifted from each other in time series. Therefore, the maximum current peak value can be greatly reduced. Accordingly, even if an inexpensive scan driver IC having a small current capacity is used, a good display can be realized, and the cost can be reduced.

In addition, it is preferred that a time for maintaining the potential of the second electrode at the first potential is 0.5 to 50 microseconds, and assuming that the addressing time for each display cell is "1", a time for maintaining the potential of the second electrode at the first potential is 0.3 to 30.

Furthermore, the step of applying the voltage generating the space electric discharge, between the first electrode and the third electrode, can include the step of applying a displaying voltage pulse corresponding to a display data, to the third electrodes, while sequentially applying an addressing voltage pulse to the first electrodes, and the step of changing the potential of the second electrode to the second potential can include the step of changing the potential of the second electrode to the second potential during a period in which the addressing voltage pulse is applied to the first electrode in the same display cell, or after the addressing voltage pulse is applied to the first electrode in the same display cell.

Alternatively, the step of applying the voltage generating the space electric discharge, between the first electrode and the third electrode, can include the step of applying a displaying voltage pulse corresponding to a display data, to the third electrodes, while sequentially applying an addressing voltage pulse to the first electrodes, and the step of changing the potential of the second electrode to the second potential can include the step of applying a voltage pulse of the first potential to the second electrode in synchronism with or in advance to application of the addressing voltage pulse to the first electrode in the same display cell, and the step of changing and maintaining the potential of the second electrode to the second potential during a period in which the addressing voltage pulse is applied to the first electrode, or after the addressing voltage pulse is applied to the first electrode. In this case, it is preferred that a pulse width of the voltage pulse applied to the second electrode is 0.5 to 50 microseconds, or 0.3 to 30 times the pulse width of the addressing voltage pulse.

Furthermore, the step of applying the voltage generating the space electric discharge, between the first electrode and the third electrode, can include the step of applying a displaying voltage pulse corresponding to a display data, to the third electrodes, while sequentially applying an addressing voltage pulse to the first electrodes, and the step of changing the potential of the second electrode to the second potential can include the step of applying to all the second electrodes, a voltage pulse of the first potential having a pulse width narrower than that of the addressing voltage pulse, in synchronism with application of each addressing voltage pulse, and the step of maintaining the potential of the second electrode at the second potential during a period in which the addressing voltage pulse is applied.

In this case, it is preferred that a pulse width of the voltage pulse applied to the second electrode is not less than 0.5 microseconds, or 0.3 to 0.8 times the pulse width of the addressing voltage pulse.

Still further, the plurality of second electrodes are divided into a first group and a second group which are connected to separate drive circuits, respectively. The step of applying the voltage generating the space electric discharge, between the first electrode and the third electrode, can include the step of applying a displaying voltage pulse corresponding to a display data, to the third electrodes, while sequentially applying an addressing voltage pulse to the first electrodes, and the step of changing the potential of the second electrode to the second potential can include the step of maintaining the potential of all the second electrodes included in the first group at the first potential only during a time period shorter than the pulse width of the address voltage pulse, in synchronism with application of the addressing voltage pulse to the first electrode provided in the display cell including one electrode of the second electrodes included in the first group, while maintaining the potential of all the second electrodes included in the second group at the second potential during the time period, and the step of maintaining the potential of all the second electrodes included in the first group at the second potential during a second time period after the first mentioned time period of maintaining at the first potential, while maintaining the potential of all the second electrodes included in the second group at the first potential during the second time period, so that phase-inverted voltages are applied to the first group of second electrodes and the second group of second electrodes, respectively. In this case, it is preferred that a time period for maintaining the second electrode at the first potential during the period in which the addressing voltage pulse is applied to the first electrode, is not less than 0.5 microseconds, or is not less 0.3 times the pulse width of the addressing voltage pulse. In addition, the method can further include the step of utilizing an electric power stored in a capacitance component of one group of the first group of second electrodes and the second group of second electrodes, for charging the second electrodes of the other group, in response to the voltage inversion.

EMBODIMENTS

Figure 1:
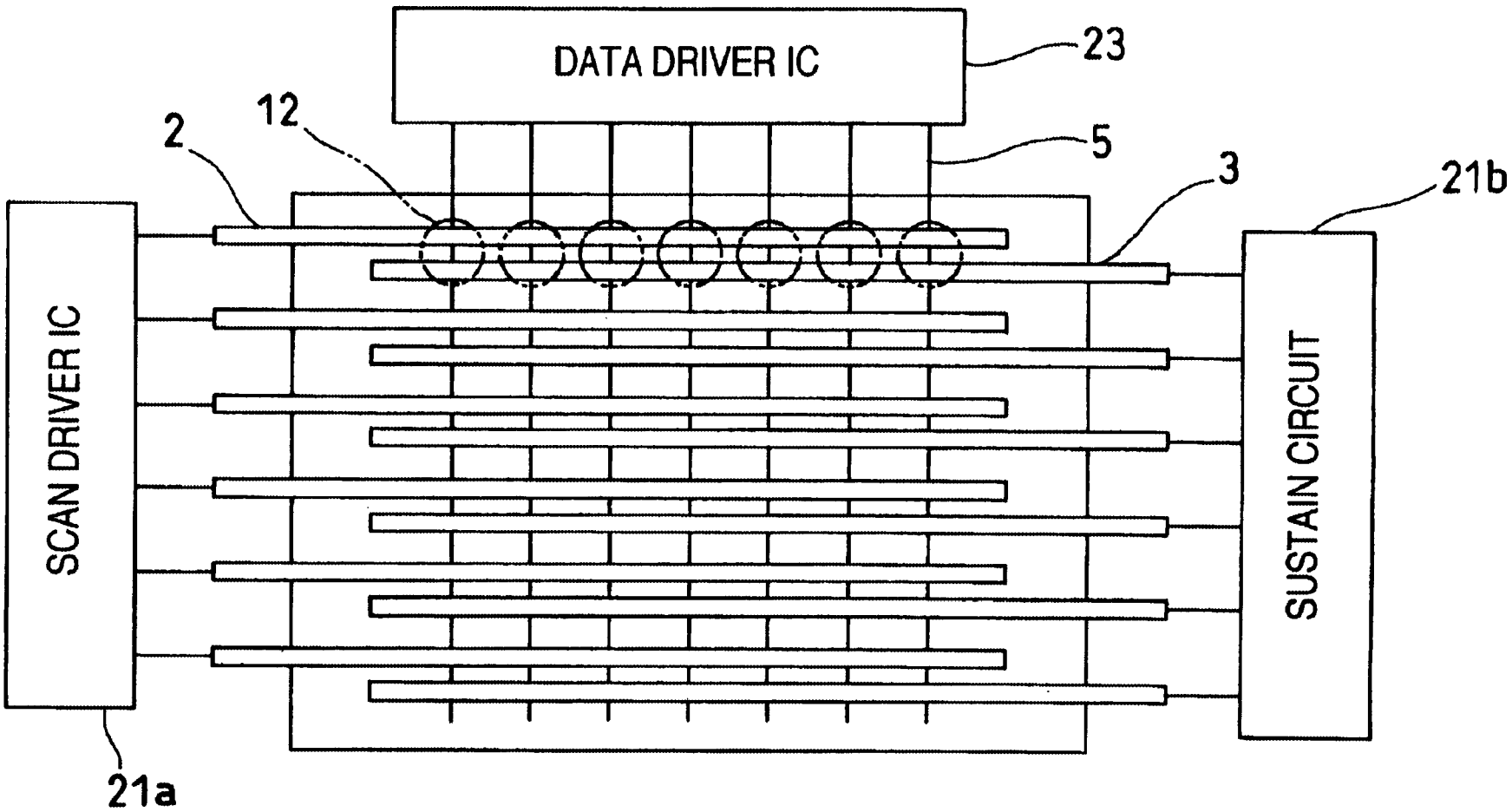
FIG. 1 is a diagram of illustrating an electrode location in the plasma display panel driven with a first embodiment of the plasma display panel driving method in accordance with the present invention.

Now, embodiments of the plasma display panel driving method in accordance with the present invention will be described in detail with reference to the accompanying drawings. FIG. 1 is a diagram of illustrating an electrode location in the plasma display panel driven with a first embodiment of the plasma display panel driving method in accordance with the present invention.

In the plasma display panel driven in accordance with the first embodiment of the present invention, one display cell 12 is formed on each intersection between one scan electrode 2 and one sustain electrode 3 and one data electrode 5 extending orthogonally to these electrodes. The scan electrodes 2 are connected to a scan driver IC 21*a* so that a scan voltage pulse is individually applied to each scan electrode. The sustain electrodes 3 are connected to a scan driver IC 22*a* so that a voltage pulse is individually applied to each sustain electrode. In addition, the data electrodes 5 are connected to a data driver integrated circuit 23 so that a data pulse can be individually applied to the data electrodes.

Figure 2:
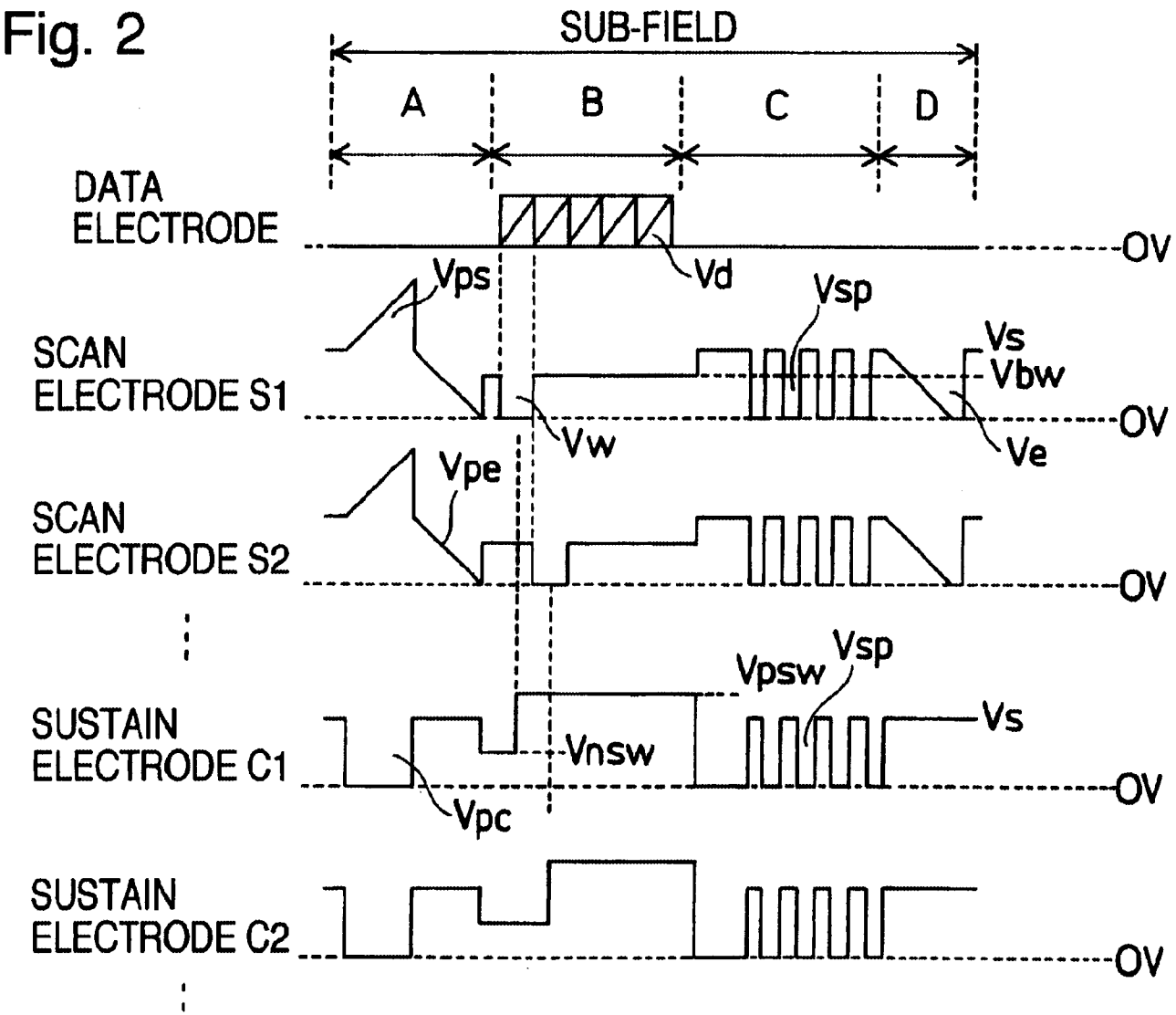
FIG. 2 is a timing chart for illustrating the first embodiment of the plasma display panel driving method in accordance with the present invention.
Figure 3A:
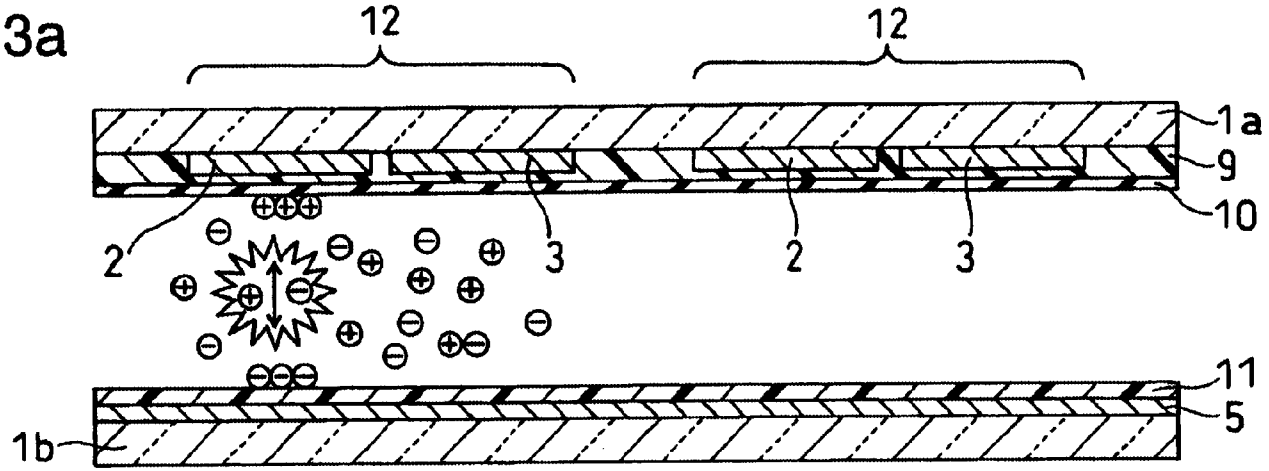
FIGS. 3*a* and 3*b* are diagrams for illustrating a wall electric charge within the display cell in the first embodiment.
Figure 3B:
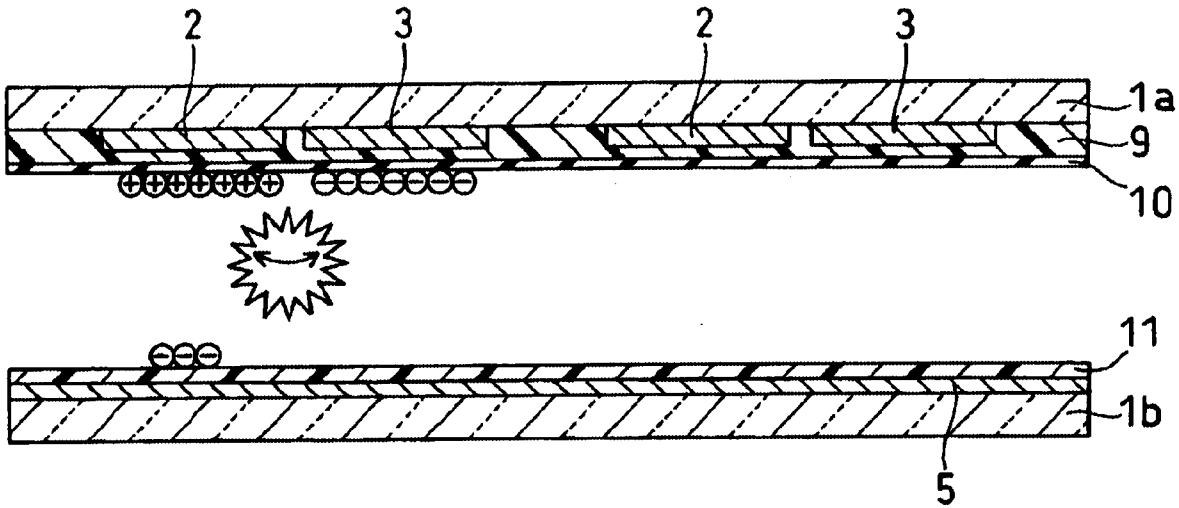

Next, an operation of the plasma display panel thus constructed, namely, a driving method therefor, will be described. FIG. 2 is a timing chart for illustrating the first embodiment of the plasma display panel driving method in accordance with the present invention. FIGS. 3*a* and 3*b* are diagrams for illustrating a wall electric charge within the display cell in the first embodiment. FIG. 3*a* illustrates the condition of the wall electric charge when a first auxiliary scan voltage is applied to the sustain electrode 3 in a period B, and FIG. 3*b* illustrates the condition of the wall electric charge when a second auxiliary scan voltage is applied to the sustain electrode 3 in the period B. In FIG. 2, a period A is a preliminary electric discharge period for facilitating generation of an electric discharge in a succeeding selection period, and a period B is a selection period for on-off selecting the luminescence of each display cell. A period C is a sustain period for causing an illuminant electric discharge in all the selected display cells, and a period D is a sustain extinguishing period for extinguishing the illuminant electric discharge. Here, in this first embodiment, a reference potential of a surface electrode composed of the scan electrodes 2 and the sustain electrodes 3 is a sustain voltage Vs for sustaining the electric discharge during the sustain period C. Therefore, in connection with the scan electrode 2 and the sustain electrode 3, a potential higher than the sustain voltage Vs is called to have a positive polarity, and a potential lower than the sustain voltage Vs is called to have a negative polarity. The sustain voltage Vs is +170V for example. In addition, in connection with the potential of the data electrode 5, 0V is considered to be a reference.

First, in the preliminary electric discharge period A, a positive sawtooth preliminary electric discharge pulse Vps is applied to the scan electrodes 2, and simultaneously, a negative rectangular preliminary pulse Vpc is applied to the sustain electrode 3. The pulse-height value of these preliminary electric discharge pulses is set to exceed an electric discharge starting threshold voltage between the scan electrode 2 and the sustain electrode 3. For example, assuming that the electric discharge starting threshold voltage of a surface electric discharge is 170V, the preliminary electric discharge pulse Vps is set to +200V and the preliminary pulse Vpc is set to 0V. Accordingly, when the preliminary electric discharge pulses Vps and Vpc are applied to the corresponding electrodes, the voltage of the sawtooth preliminary electric discharge pulse Vps increases, and after a voltage between both the electrodes exceeds the electric discharge starting threshold voltage, a weak electric discharge is generated between the scan electrode 2 and the sustain electrode 3. As a result, a negative wall electric charge is formed on the scan electrode 2, and a positive wall electric charge is formed on the sustain electrode 3.

Succeeding to the preliminary electric discharge pulses Vps, a negative sawtooth preliminary electric discharge extinguishing pulse Vpe is applied to the scan electrode 2. An attainment potential of the preliminary electric discharge extinguishing pulse Vpe is set to for example 0V. At this time, the potential of the sustain electrode 3 is fixed to the sustain voltage Vs. With application of the preliminary electric discharge extinguishing pulse Vpe, the wall electric charge on the scan electrode 2 and the sustain electrode 3 is extinguished. Here, even after the wall electric charge is extinguished, space-charges such as electrons and ions and active particles such as quasi-stable particles generated in the preliminary electric discharge exists in the electric discharge space 6, even if those are a little amount. In addition, the extinction of the wall electric charge during the preliminary electric discharge period A includes adjustment of the wall electric charge in order to cause the succeeding operations such as the selection operation and the sustain electric discharge to be carried out in a good condition.

Next, in the selection period B, after the potential of the scan electrodes 2 are fixed to a scan base potential Vbw once, a negative scan pulse Vw is sequentially applied to each scan electrode 2, and a data pulse Vd corresponding to a display data is individually applied to each data electrode 5. Here, the scan pulse Vw and the data pulse Vd are set to ensure that a voltage difference between confronting electrodes constituted of the scan electrode 2 and the data electrode 5 never exceeds the electric discharge starting threshold voltage when only either one of the scan pulse Vw and the data pulse Vd is applied, but exceeds the electric discharge starting threshold voltage when both the scan pulse Vw and the data pulse Vd are superposed. For example, assuming that the electric discharge starting threshold voltage of the space electric discharge is 200V, the scan pulse Vw is set to 0V and the data pulse Vd is set to 60V. In addition, the base potential Vbw is set to 80V. Furthermore, the pulse width of the scan pulse Vw is set to be on the order of 1.5 to 3.0 microseconds, and the data pulse Vd is also set to have a similar pulse width.

On the other hand, the sustain electrode 3 is fixed to a first auxiliary scan voltage Vnsw once from an initial stage of the selection period B. Thereafter, in the sustain electrode 3*i* corresponding to an (i)th scan electrode 2*i* in the scanning order for applying the scan pulse Vw, the sustain electrode potential is sequentially changed to a second auxiliary scan voltage Vpsw at a timing which is later than the application of the (i)th scan pulse Vwi by a half of the pulse width of the (i)th scan pulse Vwi. Here, the first auxiliary scan voltage Vnsw is set to a voltage (for example 80V) which never generates the surface electric discharge between the scan electrode 2 and the sustain electrode 3 even if the space electric discharge is generated between the data electrode 5 and the scan electrode 2. In addition, the second auxiliary scan voltage Vpsw is set to a voltage (for example Vs+40V) which can ensure such a relation that no electric discharge occurs with only a voltage difference between the scan pulse Vw and the second auxiliary scan voltage Vpsw, but a surface electric discharge occurs between the scan electrode 2 and the sustain electrode 3 only when a large amount of active particles exist in the electric discharge space.

By changing the potential of the sustain electrode 3 during the selection period B in this manner, the space electric discharge occurs between the data electrode 5 and the scan electrode 2 at a first half of each scan pulse Vw as shown in FIG. 3*a*, so that a negative wall electric charge is formed on the data electrode 5, and a positive wall electric charge is formed on the scan electrode. Because a small amount of space electric charges and active particles exist in the electric discharge space 6 for the electric discharge and the extinction of the wall electric charge during the preliminary electric discharge period A, this space electric discharge is stably generated with an electric discharge probability depending upon the amount of the electric charges and active particles. Furthermore, just after termination of the space electric discharge, a large amount of active particles exist in the electric discharge space as shown in FIG. 3*a*. On the other hand, in the display cell 12 in which the space electric discharge has occurred in the first half of the scan pulse Vw, since an electric discharge starting voltage greatly lowers because of a large amount of active particles existing in the electric discharge space 6, an electric discharge is generated between the scan electrode 2 and the sustain electrode 3 in a second half of each scan pulse Vw as shown in FIG. 3*b*, so that the positive wall electric charge on the scan electrode 2 increases, and a negative wall electric charge is formed on the sustain electrode 3. However, in the display cell 12 in which no space electric discharge has occurred in the first half of the scan pulse Vw, even if the second auxiliary scan voltage Vpsw is applied, no electric discharge occurs between the scan electrode 2 and the sustain electrode 3.

Depending upon the kind of the electric discharge gas and the structure of the plasma display panel, when the electric discharge probability is high, the space electric discharge between the scan electrode 2 and the data electrode 5 is generated with a delay of about 0.5 microseconds after application of the scan pulse Vw, and the peak of the electric discharge current appears with a further delay of about 0.2 microseconds. Accordingly, if the potential transition of the sustain electrode 3 is delayed from application of the scan pulse Vw by the order of 1 microsecond, since the peak of the electric discharge current has already elapsed, it is possible to separate the space electric discharge and the surface electric discharge from each other, and to suppress the peak current at a low value. Actually, since an electric discharge generation delay occurs in the surface electric discharge, it is possible to separate the current peak if the potential transition is delayed from the application of the scan pulse Vw by about 0.5 microseconds. However, in order to surely separate the peak of the electric discharge current, the delay time is preferred to be on the order of 1 microsecond. In addition, considering this value on the basis of the width of the scan pulse Vw, if the pulse width is 1.5 microseconds, it is possible to separate the peak of the electric discharge current into the space electric discharge and the surface electric discharge by setting the delay time to 0.3 times the pulse width at minimum, and preferably to 0.6 times the pulse width.

Thereafter, in the sustain period C, phase-inverted sustain pulses Vsp having the same pulse-height value as that of the sustain voltage Vs are supplied to all the scan electrodes 2 and all the sustain electrodes 3, respectively. Accordingly, the sustain electric discharge for the luminescence is generated in only the display cells 12 having the wall electric charge formed by the writing electric discharge generated in the selection period B, with the result that a displaying luminance is obtained.

In the succeeding sustain extinguishing period D, the voltage of the sustain electrodes 3 are fixed to the sustain voltage Vs, and a negative sawtooth sustain extinguishing pulse Ve is applied to the scan electrodes 2. In this process, the wall electric charge on the surface electrodes is extinguished so that it is returned into an initial condition, namely, a condition before the preliminary electric discharge pulses Vps and Vpc are applied during the preliminary electric discharge period A. Incidentally, the extinction of the wall electric charge during the sustain extinguishing period D includes adjustment of the wall electric charge in order to cause the succeeding operations to be carried out in a good condition.

In this first embodiment, during the selection period B, in the display cell 12 having a high electric discharge probability, the space electric discharge occurring between the scan electrode 2 and the data electrode 5 can be separated in time series from the surface electric discharge occurring between the scan electrode 2 and the sustain electrode 3. As a result, the overlap of the peak currents is avoided, so that the peak value of the current flowing through the scan driver IC 22*a* can be greatly reduced. Incidentally, in the case of a low electric discharge probability, in some of the display cells 12 the space electric discharge between the scan electrode 2 and the data electrode 5 would occur in the second half of the period of application of the scan pulse Vw, and in this case, the space electric discharge and the surface electric discharge triggered by the space electric discharge would occur substantially simultaneously. However, since those space electric discharge and surface electric discharge will not occur concentratedly inherently, the peak value of the current flowing through the scan driver IC 22*a* never becomes a large load to the scan driver IC 22*a*, with the result that no problem is encountered.

Accordingly, since the peak current flowing through the scan driver IC 21*a* is greatly reduced, it is possible to use an inexpensive scan driver IC having a small current capacity. In addition, in the circuit shown in FIG. 1, a scan circuit connected to the sustain electrodes 3 is required. However, since a scan driver IC 22*b* connected to the sustain electrodes 3 is sufficient if it can flow the electric discharge current attributable to the surface electric discharge, it is possible to use a scan driver IC having a small current capacity. Thus, the overall cost can be reduced in comparison with the conventional examples.

Figure 4:
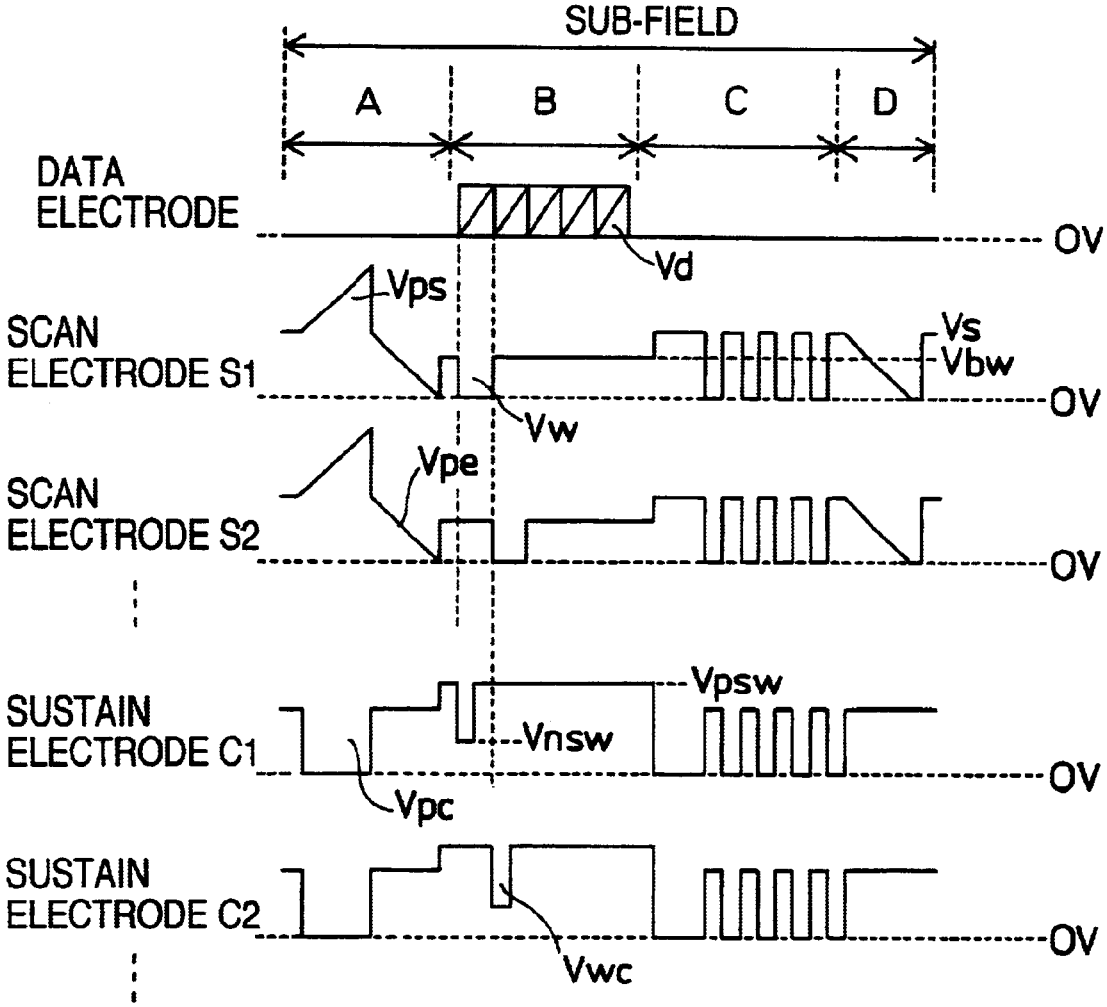
FIG. 4 is a timing chart for illustrating a second embodiment of the plasma display panel driving method in accordance with the present invention.

Now, a second embodiment of the present invention will be described. The second embodiment is a method for driving the plasma display panel having the structure shown in FIG. 1, similarly to the first embodiment. FIG. 4 is a timing chart for illustrating the second embodiment of the plasma display panel driving method in accordance with the present invention.

First, in a preliminary electric discharge period A, similarly to the first embodiment, a preliminary electric discharge pulse Vps and a preliminary electric discharge extinguishing pulse Vpe are applied to the scan electrodes 2, and a preliminary electric discharge pulse Vpc is applied to the sustain electrodes 3.

In a succeeding selection period B, the potential of the scan electrodes 2 is fixed to a scan base voltage Vbw once, and thereafter, a negative scan pulse Vw is sequentially applied to each scan electrode 2, and a data pulse Vd corresponding to a display data is individually applied to each data electrode 5.

On the other hand, the potential of the sustain electrodes 3 is fixed to a second auxiliary scan voltage Vpsw once. Thereafter, in the sustain electrode 3*i* corresponding to an (i)th scan electrode 2*i* in the scanning order for applying the scan pulse Vw, an auxiliary scan pulse Vwc is applied as the same time as the (i)th scan pulse Vwi is applied. The potential of this auxiliary scan pulse Vwc is set to for example the same potential as that of the first auxiliary scan voltage Vnsw in the first embodiment. In addition, the width of the auxiliary scan pulse Vwc is set to for example a half of the pulse width of the scan pulse Vw. For example, if the pulse width of the scan pulse Vw is 2 microseconds, the width of the auxiliary scan pulse Vwc is set to 1 microsecond. With this setting of the pulse width, the potential of the sustain electrodes 3 becomes the first auxiliary scan voltage Vnsw in a first half of each scan pulse Vw and the second auxiliary scan voltage Vpsw in a second half of each scan pulse Vw, with the result that the sustain pulses can be driven in substantially the same manner as that in the first embodiment. Here, for ensuring a sufficient surface electric discharge, it is necessary to hold the potential of the sustain electrode 3 at the second auxiliary scan voltage Vpsw for a some length of time. On the other hand, when the space electric discharge has occurred, a large amount of active particles exist in the electric discharge space, so that the surface electric discharge succeeding to the space electric discharge occurs extremely quickly. Accordingly, in order to complete the surface electric discharge, it is sufficient if it has a time on the order of 0.6 microseconds. For example, considering these values with reference to the pulse width of the scan pulse Vwc, if the pulse width of the scan pulse Vwc is 3 microsecond, it may be about 0.2 times the pulse width of the scan pulse Vwc. Accordingly, if the time for holding the sustain electrodes 2 at the first auxiliary scan voltage Vnsw is not greater than 0.8 times the pulse width of the scan pulse Vwc, it is possible to separate the peak of the electric discharge current of the space electric discharge from the peak of the electric discharge current of the surface electric discharge.

Thereafter, similarly to the first embodiment, a voltage application is carried out during the sustain period C and the sustain extinguishing period, so that one sub-field is constituted.

Figure 5:
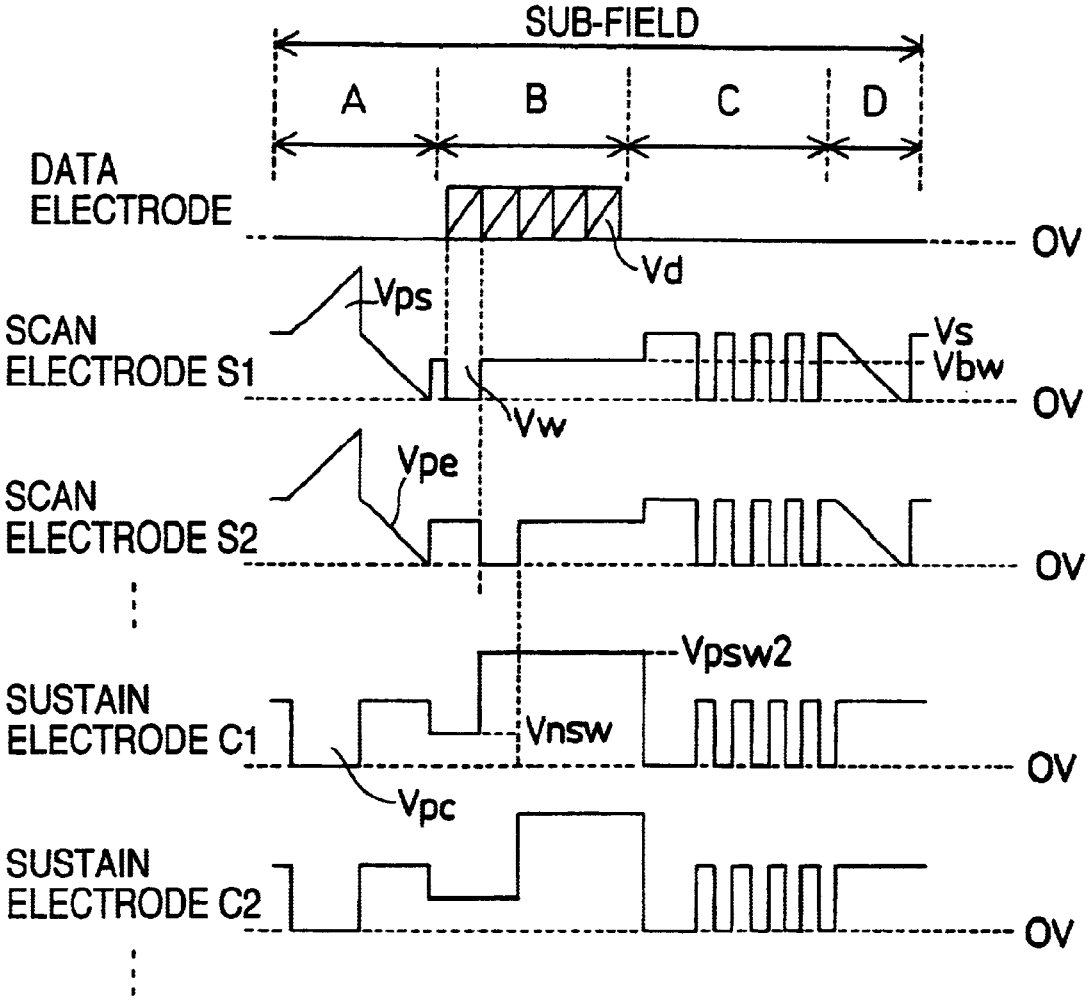
FIG. 5 is a timing chart for illustrating a third embodiment of the plasma display panel driving method in accordance with the present invention.
Figure 6A:
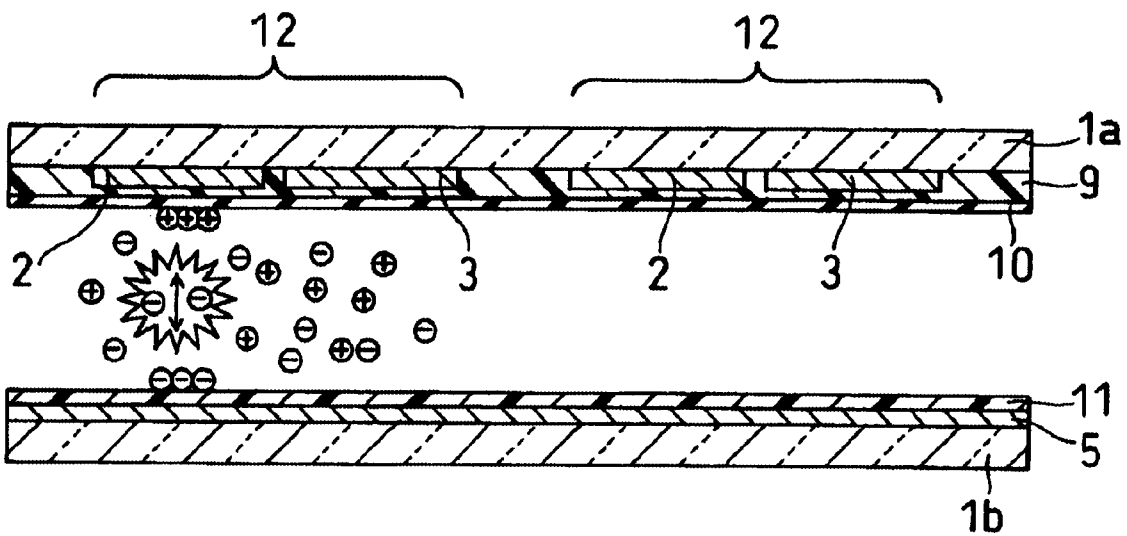
FIGS. 6*a* and 6*b* are diagrams for illustrating a wall electric charge within the display cell in the third embodiment.
Figure 6B:
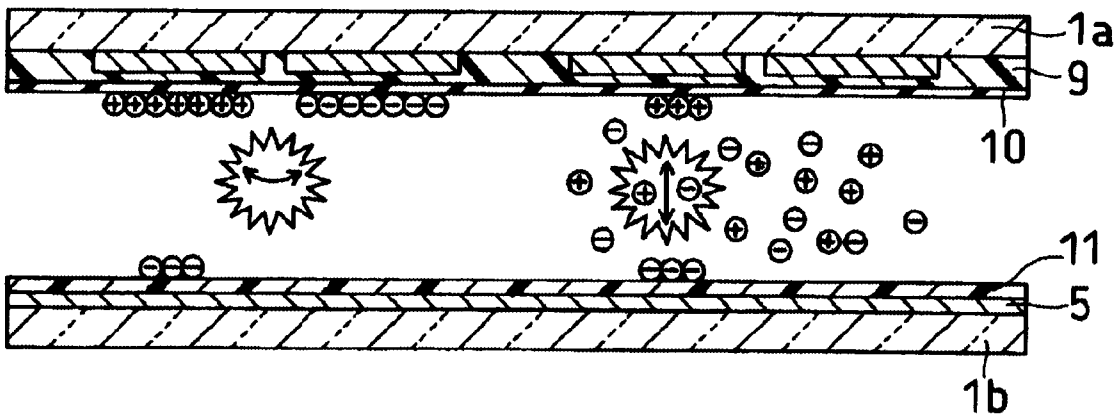

Now, a third embodiment of the present invention will be described. The third embodiment is a method for driving the plasma display panel having the structure shown in FIG. 1, similarly to the first and second embodiments. FIG. 5 is a timing chart for illustrating the third embodiment of the plasma display panel driving method in accordance with the present invention. FIGS. 6*a* and 6*b* are diagrams for illustrating a wall electric charge within the display cell in the third embodiment. FIG. 6*a* illustrates a wall electric charge when a first auxiliary scan voltage is applied to the sustain electrode 3 during the period B, and FIG. 6*b* illustrates a wall electric charge when a second auxiliary scan voltage is applied during the period B.

First, in a preliminary electric discharge period A, similarly to the first embodiment, a preliminary electric discharge pulse Vps and a preliminary electric discharge extinguishing pulse Vpe are applied to the scan electrodes 2, and a preliminary electric discharge pulse Vpc is applied to the sustain electrodes 3.

In a succeeding selection period B, the potential of the scan electrodes 2 is fixed to a scan base voltage Vbw once, and thereafter, a negative scan pulse Vw is sequentially applied to each scan electrode 2, and a data pulse Vd corresponding to a display data is individually applied to each data electrode 5.

On the other hand, the sustain electrode 3 is fixed to a first auxiliary scan voltage Vnsw once, and thereafter, in the sustain electrode 3*i* corresponding to an (i)th scan electrode 2*i* in the scanning order for applying the scan pulse Vw, the sustain electrode potential is sequentially changed to a second auxiliary scan voltage Vpsw2 at the same time as termination of the application of the (i)th scan pulse Vwi. Here, similarly to the first embodiment, the first auxiliary scan voltage Vnsw is set to a voltage (for example 80V) which never generates the surface electric discharge between the scan electrode 2 and the sustain electrode 3 even if the space electric discharge is generated between the data electrode 5 and the scan electrode 2. In addition, the second auxiliary scan voltage Vpsw2 is set to a voltage (for example Vs+120V) which can ensure such a relation that no electric discharge occurs with only a voltage difference between the scan base voltage Vbw and the second auxiliary scan voltage Vpsw2, but a surface electric discharge occurs between the scan electrode 2 and the sustain electrode 3 only when a large amount of active particles exist in the electric discharge space.

By changing the potential of the sustain electrode 3 during the selection period B in this manner, the space electric discharge occurs between the data electrode 5 and the scan electrode 2 by each scan pulse Vw and each data pulse Vd during a period in which the scan pulse Vw is being applied, as shown in FIG. 6*a*, so that a negative wall electric charge is formed on the data electrode 5, and a positive wall electric charge is formed on the scan electrode 2. Because a small amount of space electric charges and active particles exist in the electric discharge space 6 for the electric discharge and the extinction of the wall electric charge during the preliminary electric discharge period A, this space electric discharge is stably generated with an electric discharge probability depending upon the amount of the electric charges and active particles. Furthermore, just after termination of the space electric discharge, a large amount of active particles exist in the electric discharge space as shown in FIG. 6*a*. Thereafter, the scan pulse Vw is removed so that the potential of the scan electrode 2 is returned to the scan base voltage Vbw, and on the other hand, the potential of the sustain electrode 2 is brought to the second auxiliary scan voltage Vpsw2. As a result, in the display cell 12 in which the space electric discharge had occurred, since the electric discharge starting voltage greatly lowers because of a large amount of active particles within the electric discharge space 6, the surface electric discharge occurs. However, in the display cell 12 in which the space electric discharge did not occur, no surface electric discharge occurs.

Figure 7:
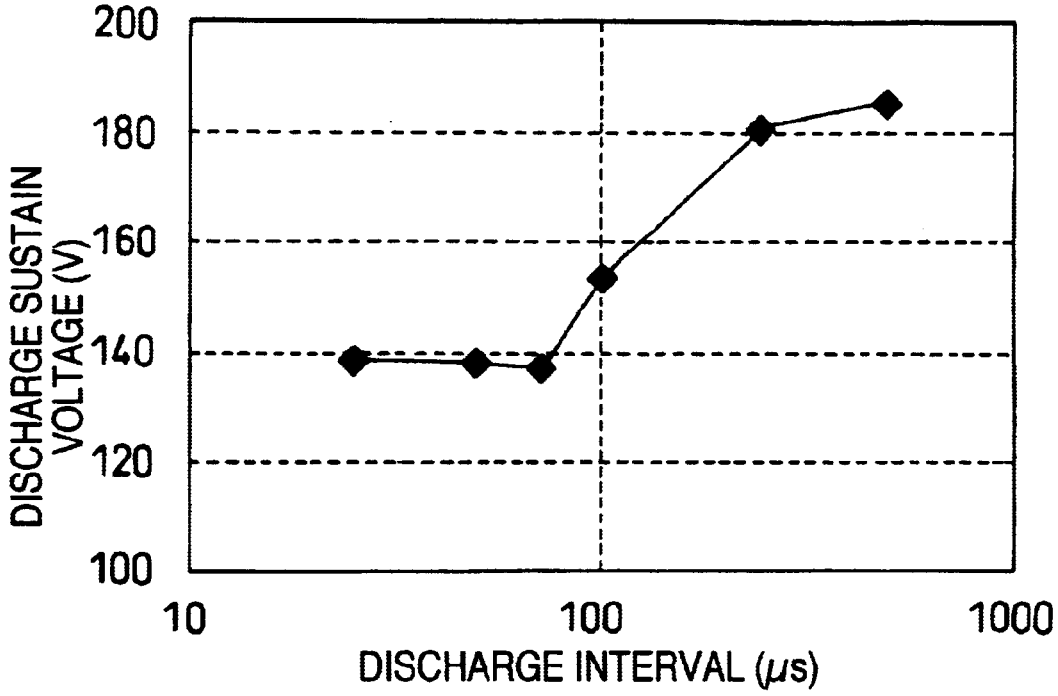
FIG. 7 is a graph illustrating the relation when a pulse-like alternating current voltage is applied between the scan electrode and the sustain electrode.

Now, this mechanism will be described. FIG. 7 is a graph illustrating the relation between an electric discharge interval (pulse interval) and an electric discharge sustain voltage when a pulse-like alternating current voltage is applied between the scan electrode and the sustain electrode, in which the axis of ordinates indicates the electric discharge interval (pulse interval) and the axis of abscissas indicates the electric discharge sustain voltage.

As shown in FIG. 7, if the pulse interval exceeds 100 microseconds, the electric discharge sustain voltage starts to abruptly increase. This means that the active particles, particularly the electrons and ions, within the electric discharge space 6, abruptly reduce after termination of the electric discharge, and the effect of the lowering of the electric discharge voltage by action of the active particles formed in the space electric discharge is maintained only for 100 microseconds after termination of the electric discharge. Therefore, in the display cell 12 in which the space electric discharge had occurred, in order to select generation or non-generation of the electric discharge by utilizing the active particles, it is sufficient if a next electric discharge is caused to start within not greater than 50 microseconds after termination of the electric discharge. In this embodiment, as mentioned above, the potential of the sustain electrode 3 is changed with a delay of a scan period of one line. Ordinarily, the scan period of one line is on the order of 1.5 to 3 microseconds, and therefore, when the potential of the sustain electrode 3 is changed to the second auxiliary scan voltage Vpsw2, a large amount of active particles exist sufficiently. Accordingly, in the display cell 12 in which the space electric discharge had occurred, the surface electric discharge occurs between the scan electrode 2 and the sustain electrode 3, with the result that as shown in FIG. 6*b*, the positive wall electric charge on the scan electrode 2 increases, and a negative wall electric charge is formed on the sustain electrode 3.

Thereafter, in the sustain period C, phase-inverted sustain pulses Vsp having the same pulse-height value as that of the sustain voltage Vs are supplied to all the scan electrodes 2 and all the sustain electrodes 3, respectively. Accordingly, the sustain electric discharge for the luminescence is generated in only the display cells 12 having the wall electric charges formed by the writing electric discharge generated during the selection period B, with the result that a displaying luminance is obtained.

In the succeeding sustain extinguishing period D, the voltage of the sustain electrodes 3 are fixed to the sustain voltage Vs, and a negative sawtooth sustain extinguishing pulse Ve is applied to the scan electrodes 2. In this process, the wall electric charge on the surface electrode is extinguished so that it is returned into an initial condition, namely, a condition before the preliminary electric discharge pulses Vps and Vpc are applied during the preliminary electric discharge period A. Incidentally, the extinction of the wall electric charge during the sustain extinguishing period D includes adjustment of the wall electric charge in order to cause the succeeding operations to be carried out in a good condition.

During the selection period B of this embodiment, the potential of the sustain electrode is changed with the delay of the scan period of one line. As mentioned above, however, the time delay for changing the potential can be extended to about 50 microseconds. Considering this on the basis of the scan period of one line, if the scan period is for example 1.5 microseconds, the time delay for changing the potential can be extended to about 30 times the scan period of one line.

In the third embodiment mentioned above, during the selection period B, the peak of the space electric discharge occurring between the scan electrode 2 and the data electrode 5 can be separated in a time series from the peak of the surface electric discharge occurring between the scan electrode 2 and the sustain electrode 3. As a result, the peak value of the current flowing through the scan driver IC can be greatly reduced. Accordingly, since the peak current flowing through the scan driver IC is greatly reduced, it is possible to use an inexpensive scan driver IC having a small current capacity, and therefore, the cost can be reduced.

Furthermore, in this embodiment, after application of the scan pulse Vw, the potential of the scan electrode 2 is fixed to the scan base voltage Vbw, and the potential of the sustain electrode 3 is fixed to the second auxiliary scan voltage Vpsw2, the time for applying the voltage generating the surface electric discharge can be ensured to have a long time. Therefore, even if the electric discharge probability of the surface electric discharge to be generated following the space electric discharge lowers to some degree with the result that the timing of generation of the electric discharge becomes different from one to another, it is possible to stably form the wall electric charge enough to transfer to the sustain electric discharge.

Figure 8:
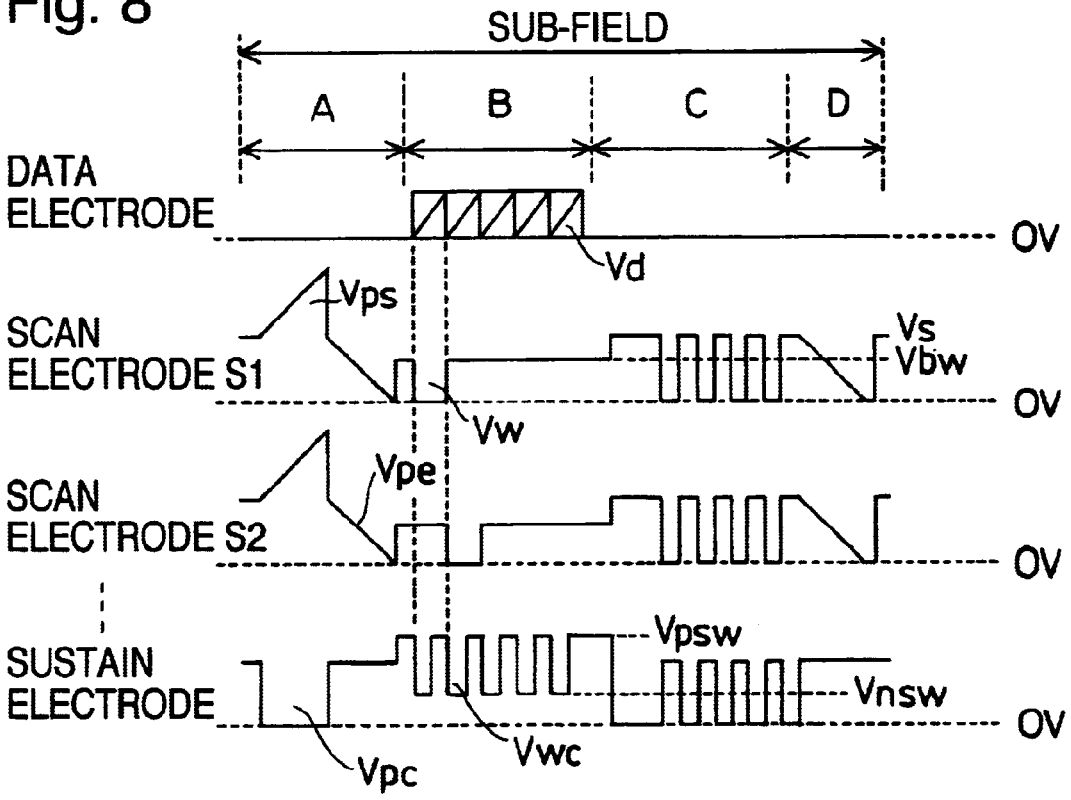
FIG. 8 is a timing chart for illustrating a fourth embodiment of the plasma display panel driving method in accordance with the present invention.
Figure 13:
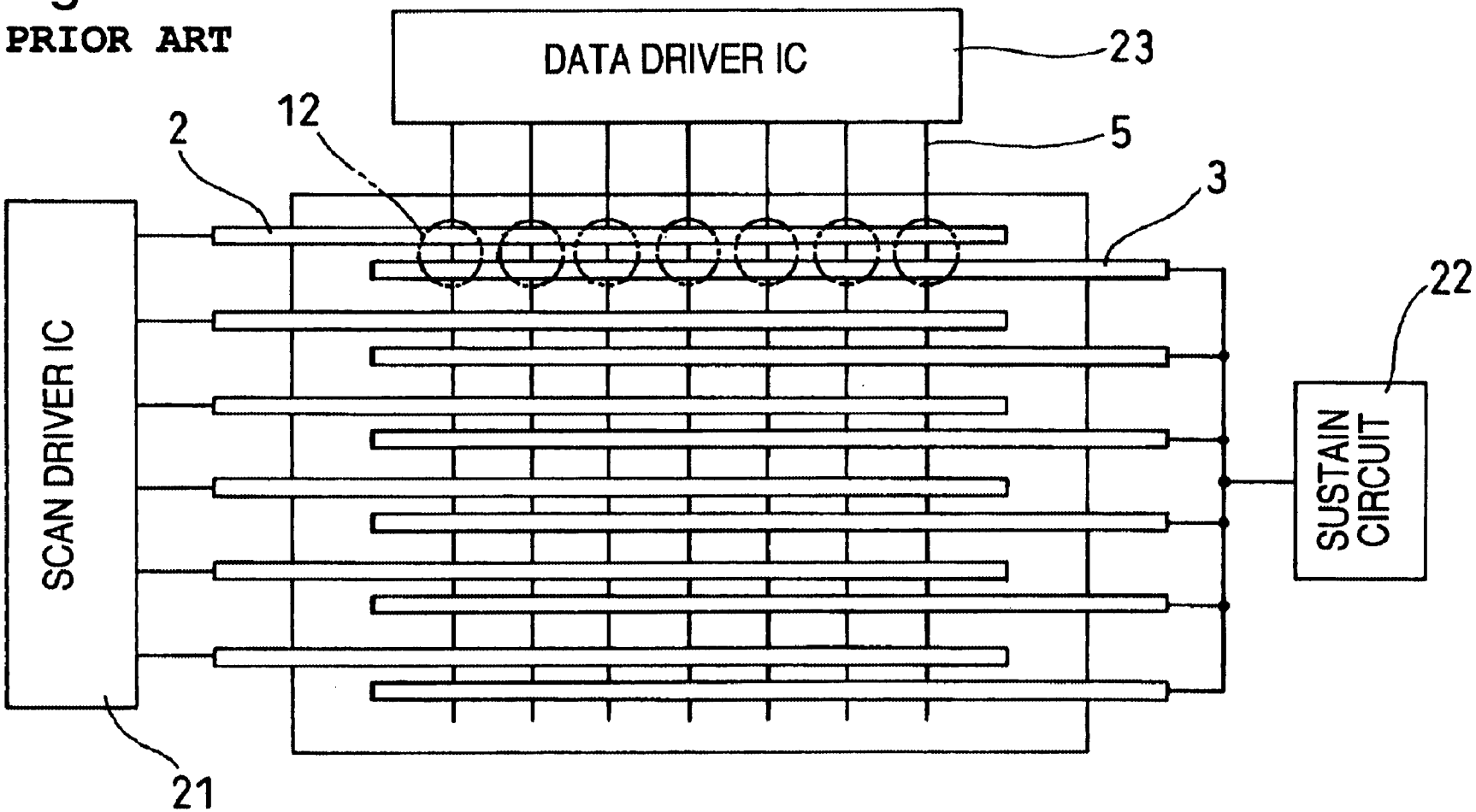
Fig. 13 PRIOR ART
FIG. 13 is a diagram of illustrating an electrode location in the conventional plasma display panel.
Figure 14:
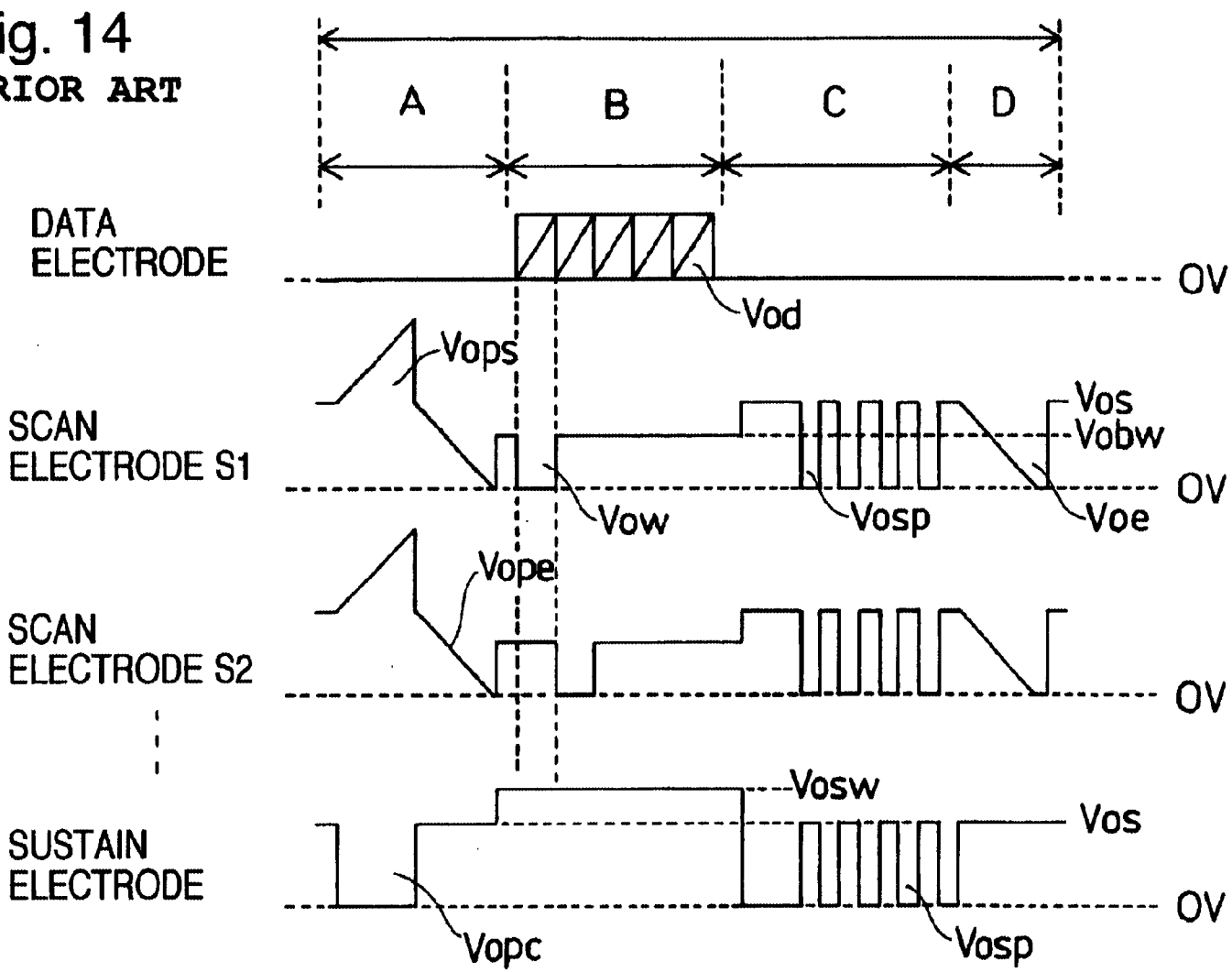
Fig. 14 PRIOR ART
FIG. 14 is a timing chart for illustrating voltage pulses applied to various electrodes in a first conventional driving method.
Figure 15:
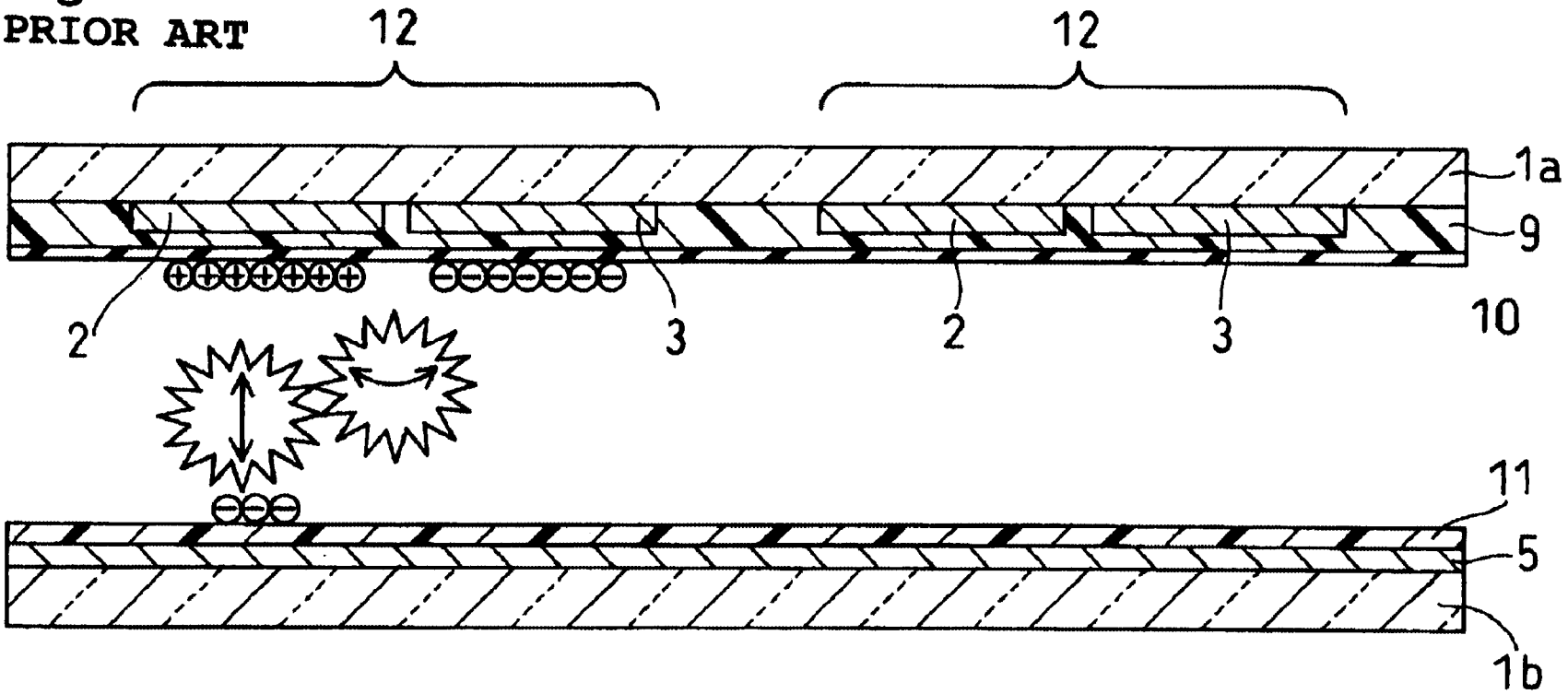
Fig. 15 PRIOR ART
FIG. 15 is a diagram for illustrating a wall electric charge within the display cell during a selection period B in the first conventional driving method.
Figure 16:
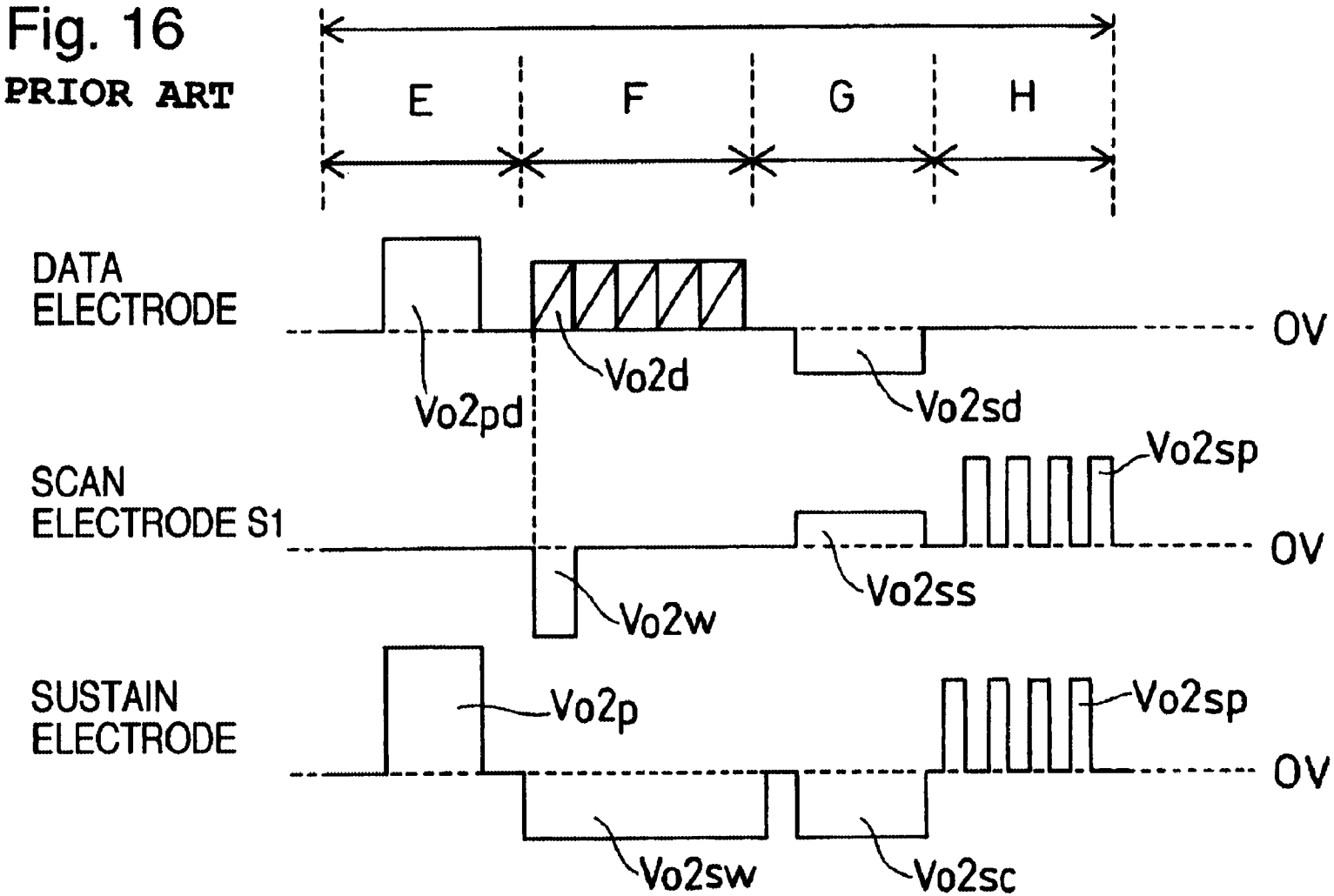
Fig. 16 PRIOR ART
FIG. 16 is a timing chart for illustrating voltage pulses applied to various electrodes in a second conventional driving method.
Figure 17A:
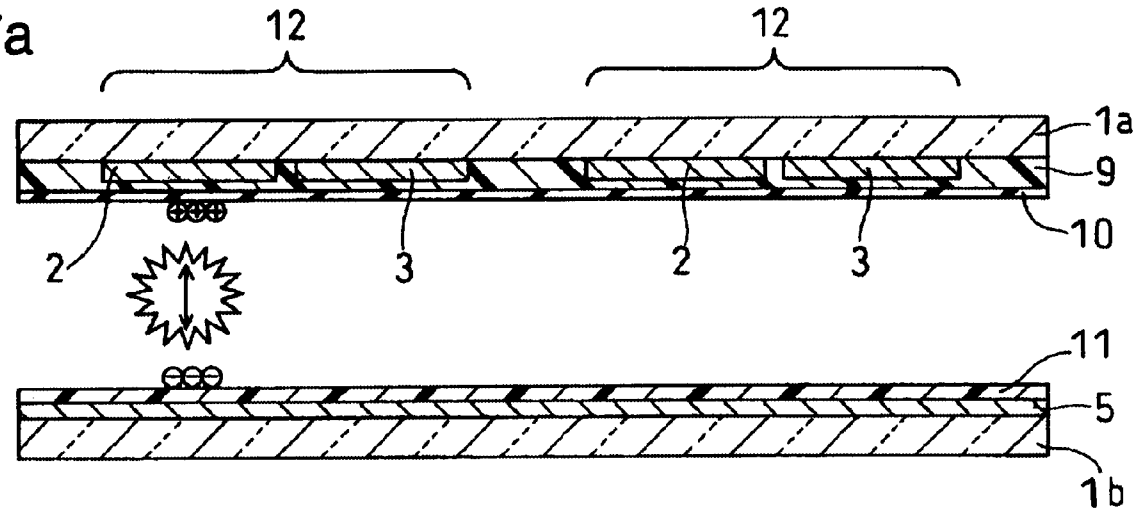
PRIOR ART Fig. 17a
FIGS. 17*a* and 17*b* are diagrams for illustrating a wall electric charge within the display cell in the second conventional driving method.
Figure 17B:
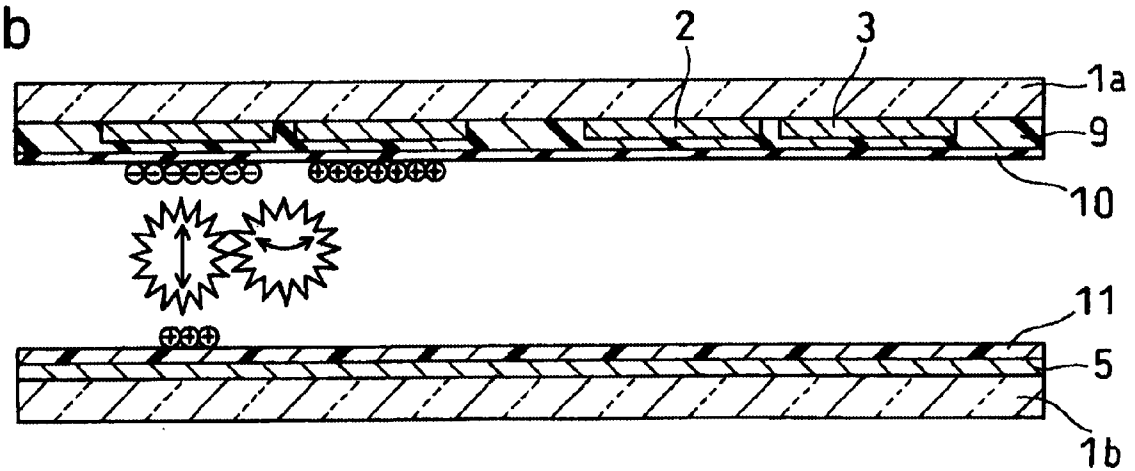
PRIOR ART Fig. 17b

Now, a fourth embodiment of the present invention will be described. Similarly to the conventional driving method, the fourth embodiment is a method for driving the plasma display panel having the structure shown in FIG. 13, namely, a plasma display panel having sustain electrodes 3 connected in common. FIG. 8 is a timing chart for illustrating the fourth embodiment of the plasma display panel driving method in accordance with the present invention.

First, in a preliminary electric discharge period A, similarly to the first embodiment, a preliminary electric discharge pulse Vps and a preliminary electric discharge extinguishing pulse Vpe are applied to the scan electrodes 2, and a preliminary electric discharge pulse Vpc is applied to the sustain electrodes 3.

In a succeeding selection period B, the potential of the scan electrodes 2 is fixed to a scan base voltage Vbw once, and thereafter, a negative scan pulse Vw is sequentially applied to each scan electrode 2, and a data pulse Vd corresponding to a display data is individually applied to each data electrode 5.

On the other hand, the sustain electrode 3 is fixed to a second auxiliary scan voltage Vpsw once, and thereafter, at the same time as each scan pulse Vwi is applied, an auxiliary scan pulse Vwc having a pulse width which is a half of the pulse width of the scan pulse Vw is applied to all the sustain pulses 3. At this time, the potential of the auxiliary scan pulse Vwc can be set to the same potential as that of the first auxiliary scan voltage Vnsw in the second embodiment. As a result, the potential of each sustain electrode 3 is brought to the first auxiliary scan voltage Vnsw in a first half of each scan pulse Vw, and to the second auxiliary scan voltage Vpsw in a second half of each scan pulse Vw, so that the driving can be carried out substantially similarly to the first and second embodiments.

In this embodiment, in the plasma display panel having all the sustain electrodes connected in common, since the driving can be carried out substantially similarly to the first and second embodiments, a similar advantage can be obtained without requiring a scan driver IC for the sustain electrodes 3. Therefore, the cost can be reduced further in comparison with the first to third embodiments.

Figure 9:
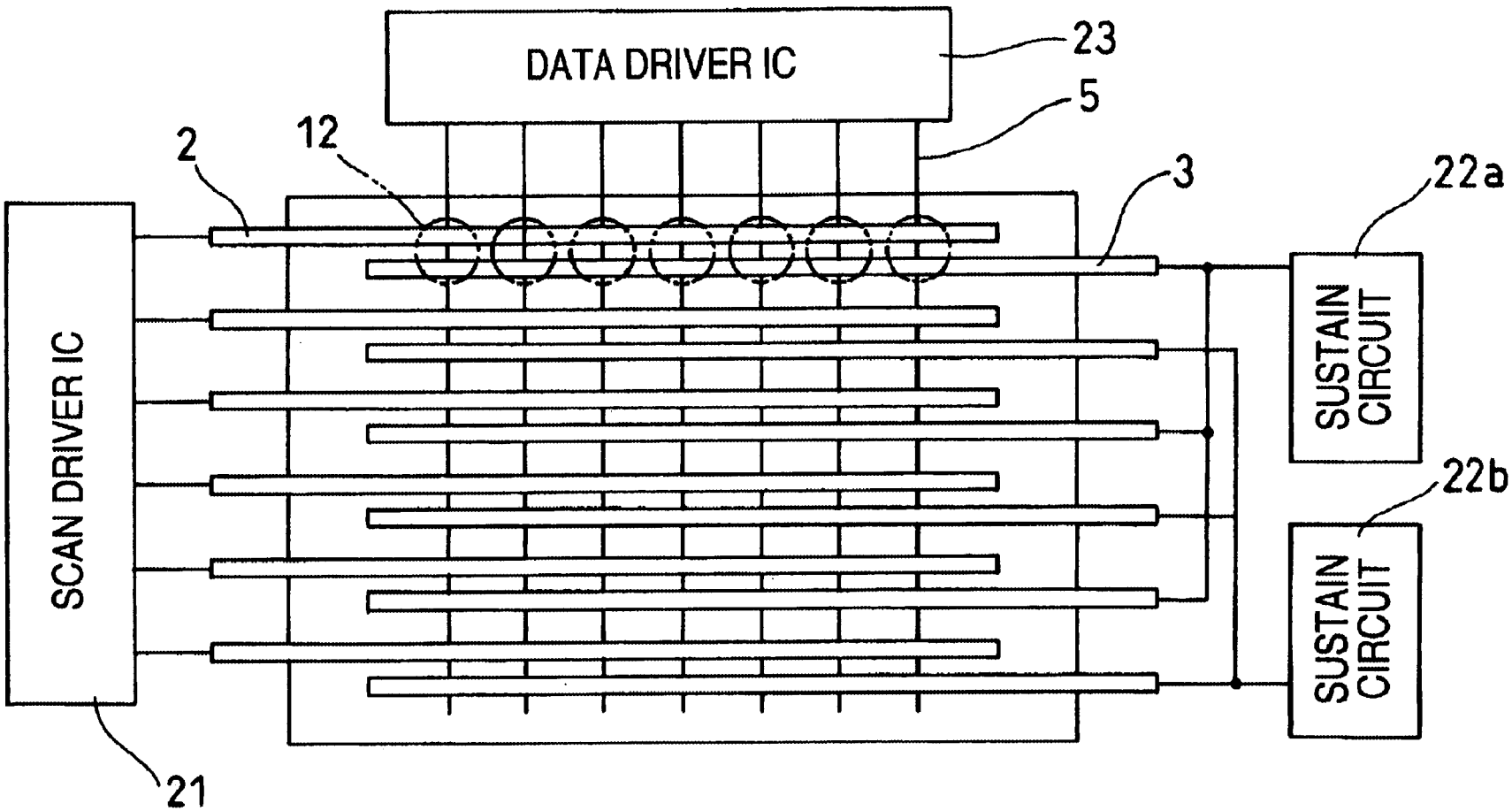
FIG. 9 is a diagram of illustrating an electrode location in the plasma display panel driven with a fifth embodiment of the plasma display panel driving method in accordance with the present invention.

Now, a fifth embodiment of the present invention will be described. FIG. 9 is a diagram of illustrating an electrode location in a plasma display panel driven with the fifth embodiment of the plasma display panel driving method in accordance with the present invention.

In the plasma display panel driven in accordance with the fifth embodiment of the present invention, one display cell 12 is formed on each intersection between one scan electrode 2 and one sustain electrode 3 and one data electrode 5 extending orthogonally to these electrodes. The scan electrodes 2 are connected to a scan driver IC 21*a* so that a scan voltage pulse is individually applied to each scan electrode. The data electrodes 5 are connected to a data driver integrated circuit (IC) 23 so that a data pulse can be individually applied to the data electrodes. On the other hand, sustain electrodes 3 are divided into a group of odd-numbered sustain electrodes corresponding to odd-numbered display lines counted from the uppermost line and connected to an odd-numbered sustain driver IC 22*a*, and another group of even-numbered sustain electrodes corresponding to even-numbered display lines counted from the uppermost line and connected to an even-numbered sustain driver IC 22*b*.

Figure 10:
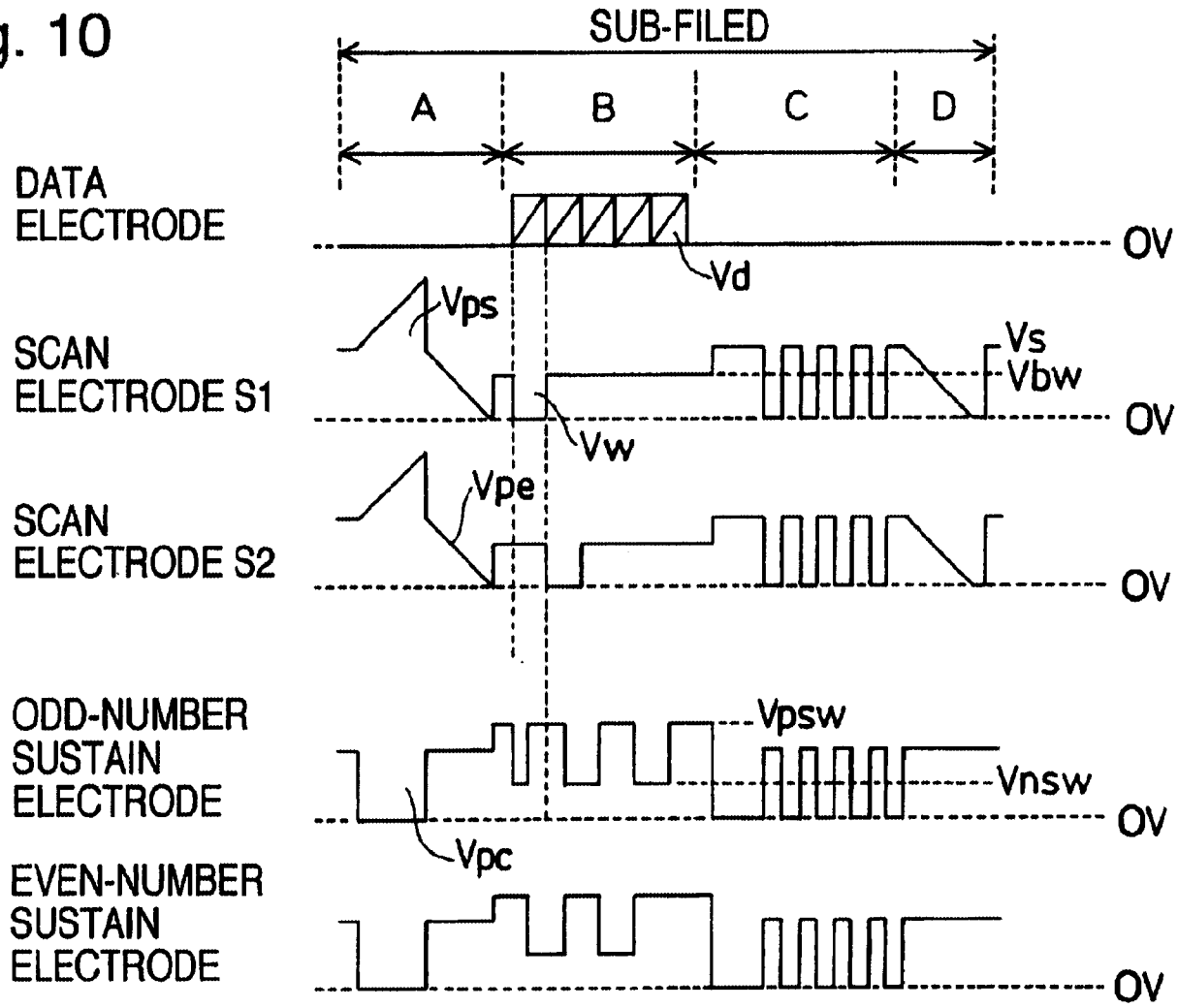
FIG. 10 is a timing chart for illustrating the fifth embodiment of the plasma display panel driving method in accordance with the present invention.

Next, an operation of the plasma display panel constructed as mentioned above, namely, a driving method therefor, will be described. FIG. 10 is a timing chart for illustrating the fifth embodiment of the plasma display panel driving method in accordance with the present invention.

First, in a preliminary electric discharge period A, similarly to the first embodiment, a preliminary electric discharge pulse Vps and a preliminary electric discharge extinguishing pulse Vpe are applied to the scan electrodes 2, and a preliminary electric discharge pulse Vpc is applied to the sustain electrodes 3.

On the other hand, the sustain electrode 3 is fixed to a second auxiliary scan voltage Vpsw once. Thereafter, in the group of odd-numbered sustain electrodes, the potential of the sustain electrodes is brought to a first auxiliary scan voltage Vnsw in a first half of the scan pulse Vw applied to the scan electrodes 2 corresponding to the odd-numbered lines and in a second half of the scan pulse Vw applied to the scan electrodes 2 corresponding to the even-numbered lines. On the other hand, in the group of even-numbered sustain electrodes, the potential of the sustain electrodes is brought to the first auxiliary scan voltage Vnsw in a first half of the scan pulse Vw applied to the scan electrodes 2 corresponding to the even-numbered lines and in a second half of the scan pulse Vw applied to the scan electrodes 2 corresponding to the odd-numbered lines. During the periods other than the above mentioned periods, both the group of odd-numbered sustain electrodes and the group of even-numbered sustain electrodes are maintained at the second auxiliary scan voltage Vpsw. As a result, the potential of each sustain electrode 3 is brought to the first auxiliary scan voltage Vnsw in a first half of each scan pulse Vw and to the second auxiliary scan voltage Vpsw in a second half of each scan pulse Vw. Therefore, the driving can be carried out similarly to the first and second embodiments.

In this embodiment, although two drive circuits are required as the drive circuit for the sustain electrodes 3, since it is possible to use a scan driver IC having a small current capacity, the cost can be reduced in comparison with the conventional drive circuit.

Figure 11:
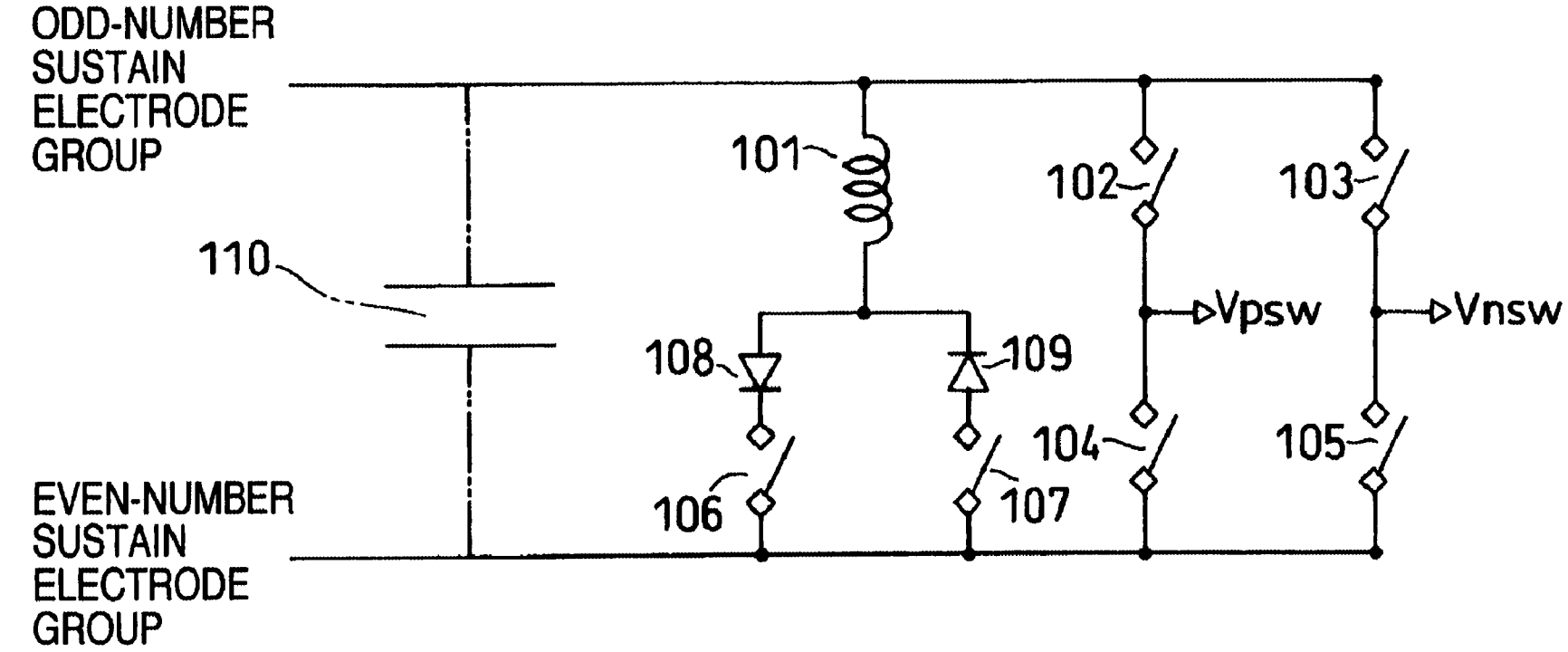
FIG. 11 is a circuit diagram symbolically showing the structure of a driving circuit for driving the sustain electrode in a selection period B in the fifth embodiment.
Figure 12:
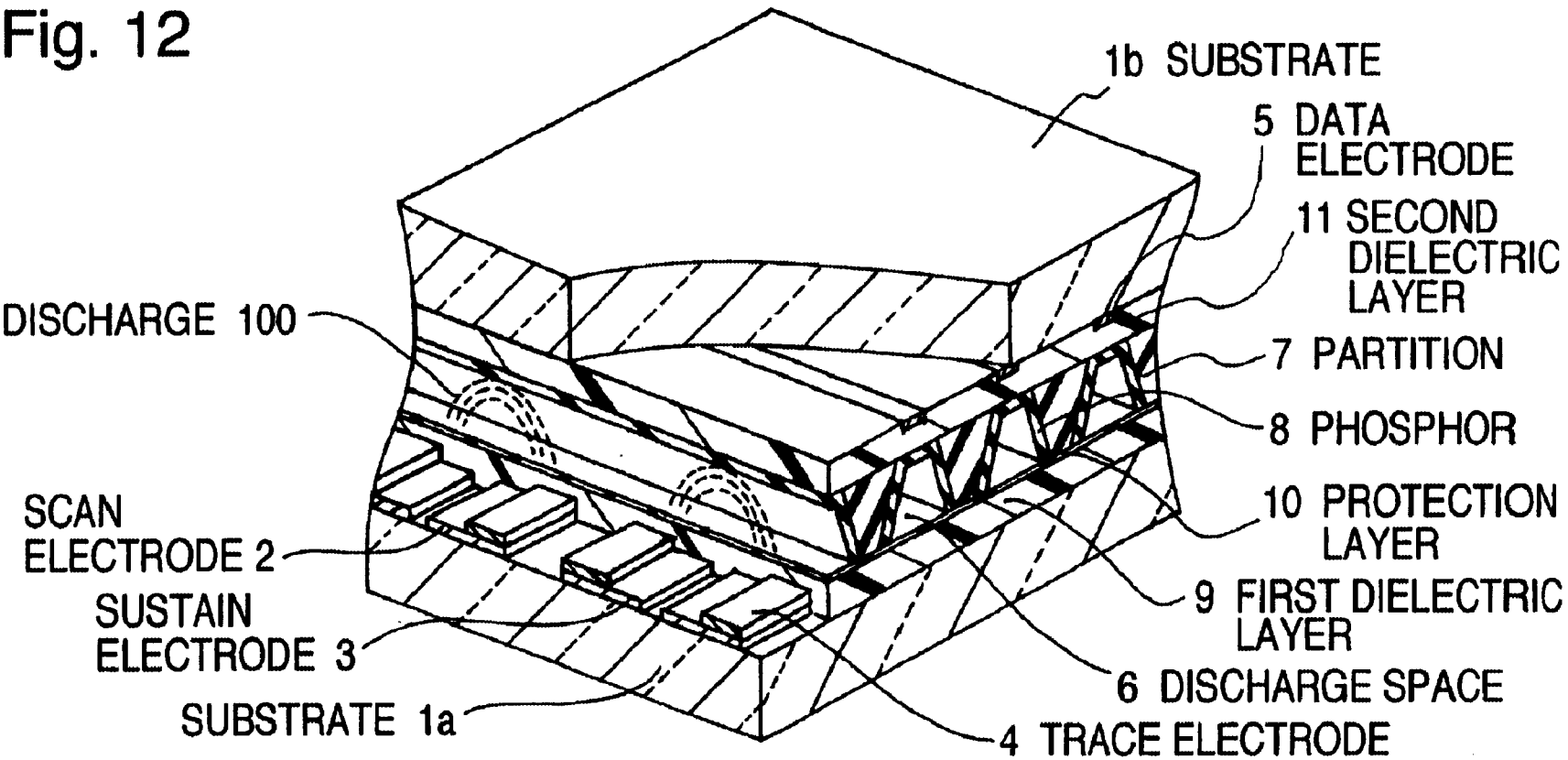
FIG. 12 is a partial sectional view of the plasma display panel.

Comparing with the fourth embodiment, the fifth embodiment can obtain the following advantages: In the fourth embodiment, the electric charging/discharging for a panel capacitance of the plasma display panel is ceaselessly carried out by the auxiliary scan pulse Vwc applied to the sustain electrode 3 during the selection period B. The current attributable to this charging/discharging is a reactive current which does not contribute for the electric discharge, and therefore, results in an increased power consumption. In the fifth embodiment, on the other hand, during the selection period B, the voltage applied to the group of odd-numbered sustain electrodes and the voltage applied to the group of even-numbered sustain electrodes are pulses opposite in phase to each other. Therefore, by exchanging an electric charge between a capacitance component which is charged and discharged in the group of odd-numbered sustain electrodes, and a capacitance component which is charged and discharged in the group of even-numbered sustain electrodes, it is possible to greatly reduce the reactive current. In the following, this reduction of the reactive current will be described in detail. FIG. 11 is a circuit diagram symbolically showing the structure of a driving circuit for driving the sustain electrodes in the selection period B in the fifth embodiment. A capacitance component 110 of the panel exists between the group of odd-numbered sustain electrodes and the group of even-numbered sustain electrodes. The drive circuit for driving the sustain electrodes includes a coil 101 cooperating with the capacitance component 110 of the panel to form a series resonant circuit. One end of the coil 101 is connected to the group of odd-numbered sustain electrodes, and the other end of the coil 101 is connected to an anode of a diode 108 and a cathode of another diode 109. A cathode of the diode 108 is connected to a switch 106, and an anode of the diode 109 is connected to another switch 107. The other end of each of the switches 106 and 107 is connected to the group of even-numbered sustain electrodes. Between the group of odd-numbered sustain electrodes and the group of even-numbered sustain electrodes, a pair of switches 102 and 104 are connected in series, and also, another pair of switches 103 and 105 are connected in series. The second auxiliary scan voltage Vpsw is supplied to a connection node between the pair of switches 102 and 104, and the first auxiliary scan voltage Vnsw is supplied to a connection node between the pair of switches 103 and 105.

Now, an operation of the drive circuit constructed as mentioned above will be described on the assumption that, in an initial condition, the second auxiliary scan voltage Vpsw and the first auxiliary scan voltage Vnsw are supplied to the group of odd-numbered sustain electrodes and the group of even-numbered sustain electrodes, respectively, and thereafter, the first auxiliary scan voltage Vnsw and the second auxiliary scan voltage Vpsw are supplied to the group of odd-numbered sustain electrodes and the group of even-numbered sustain electrodes, respectively.

In the initial condition, the switches 102 and 105 are put in a closed condition. Accordingly, the group of odd-numbered sustain electrodes are maintained at the second auxiliary scan voltage Vpsw, and the group of even-numbered sustain electrodes are maintained at the first auxiliary scan voltage Vnsw. Since the second auxiliary scan voltage Vpsw is higher than the first auxiliary scan voltage Vnsw, in the initial condition, a positive electric charge is stored at an odd-numbered sustain electrode side of the capacitance component 110 of the panel, and a negative electric charge is stored at an even-numbered sustain electrode side of the capacitance component 110 of the panel.

Next, the switches 102 and 105 are put in an open condition, and the switch 106 is put in a closed condition. Accordingly, by action of the resonant circuit formed of the capacitance component 110 of the panel and the coil 101, an electric current flows from the odd-numbered sustain electrode side through the diode 108 to the even-numbered sustain electrode side, so that an electric charge in the capacitance component 110 of the panel is exchanged. As a result, the potential of the group of odd-numbered sustain electrodes becomes near to the first auxiliary scan voltage Vnsw, and the potential of the group of even-numbered sustain electrodes becomes near to the second auxiliary scan voltage Vpsw.

Thereafter, the switch 106 is put in an open condition, and the switches 103 and 105 are put in a closed condition. The potential of the group of odd-numbered sustain electrodes reaches the first auxiliary scan voltage Vnsw, and the potential of the group of even-numbered sustain electrodes reaches the second auxiliary scan voltage Vpsw, so that the group of odd-numbered sustain electrodes are maintained at the first auxiliary scan voltage Vnsw, and the group of even-numbered sustain electrodes are maintained at the second auxiliary scan voltage Vpsw. A method as mentioned above for recovering the electric charge is disclosed in for example Japanese Patent Application Pre-examination Publication No. JP-A-08-320669.

As mentioned above, in the fifth embodiment, the reactive current expended by the charging/discharging of the capacitance component of the panel in the fourth embodiment is re-used by recovering the electric charges between the group of odd-numbered sustain electrodes and the group of even-numbered sustain electrodes. Therefore, the power consumption can be reduced in comparison with the fourth embodiment.

In the above mentioned embodiments, the scan pulse is sequentially applied to the scan electrodes in the location order. However, the order for applying the scan pulse is not limited to this applying order. In addition, the method for dividing the sustain electrodes into two groups in the fifth embodiment is not limited to only the manner of dividing the sustain electrodes into one group of sustain electrodes positioned at odd-numbered places and another group of sustain electrodes positioned at even-numbered places. But, even if the sustain electrodes are divided into two groups in any manner, if the scan pulses can be alternately applied to the sustain electrodes of the respective groups, an advantage similar to that obtained in the fifth embodiment can be obtained.

As mentioned above in detail, according to the present invention, during an addressing period it is possible to shift the current peak of the space electric discharge and the current peak of the surface electric discharge from each other in time series, with the result that the maximum current peak value can be greatly reduced. Accordingly, even if an inexpensive scan driver IC having a small current capacity is used, a good display can be realized, and the cost of the drive circuit can be reduced.

In addition, when the second electrodes (sustain electrodes) are driven in common or separately by dividing the second electrodes into two groups, since no scan driver IC for driving the second electrodes is required, the cost of the drive circuits can be greatly reduced. In particular, when the second electrodes are divided into the two groups, it is possible to recover and re-use the electric charges between the two groups. Therefore, the increase of the power consumption can be suppressed by recovering and re-using the electric charges.

Thus, it is possible to reduce the circuit cost and therefore to resultantly reduce the cost of the plasma display panel module, without deterioration of a display quality caused by a plasma damage of the phosphor layer.

What is claimed is:

1. A plasma display panel driving method for driving a plasma display panel of a matrix display scheme which includes first and second substrates located to oppose each other, a plurality of first electrodes provided on a surface of said first substrate opposing said second substrate and extending in parallel in a row direction, a plurality of second electrodes extending in parallel to said first electrodes, each of second electrodes being paired with a corresponding one of said first electrodes so that a display line is constituted by a gap between the first electrode and the second electrode adjacent to each other, a plurality of third electrodes provided on a surface of said second substrate opposing said first substrate and extending in a column direction extending orthogonally to an extending direction of said first and second electrodes, and one display cell provided at each intersection between said first and second electrodes and said third electrodes, wherein a display is controlled on the basis of whether or not an electric discharge had occurred between said first electrode and said third electrode during an addressing period, the plasma display panel driving method comprising, during said addressing period, the step of applying a voltage generating a space electric discharge, between the first electrode and the third electrode in the display cell to be displayed, while maintaining a potential of the second electrode at a first potential which does not generate a surface electric discharge between the first electrode and the second electrode, and the step of changing the potential of the second electrode in the display cell to be displayed, to a second potential which generates the surface electric discharge between the first electrode and the second electrode.

2. A plasma display panel driving method claimed in claim 1 wherein a time for maintaining the potential of said second electrode at said first potential is 0.5 to 50 microseconds.

3. A plasma display panel driving method claimed in claim 1 wherein assuming that the addressing time for each display cell is "1", a time for maintaining the potential of said second electrode at said first potential is 0.3 to 30.

4. A plasma display panel driving method claimed in claim 1 wherein the step of applying said voltage generating said space electric discharge, between said first electrode and said third electrode, includes the step of applying a displaying voltage pulse corresponding to a display data, to said third electrodes, while sequentially applying an addressing voltage pulse to said first electrodes, and the step of changing the potential of said second electrode to said second potential includes the step of changing the potential of said second electrode to said second potential during a period in which said addressing voltage pulse is applied to said first electrode in the same display cell, or after said addressing voltage pulse is applied to said first electrode in the same display cell.

5. A plasma display panel driving method claimed in claim 4 wherein a time for maintaining the potential of said second electrode at said first potential is 0.5 to 50 microseconds.

6. A plasma display panel driving method claimed in claim 4 wherein assuming that the addressing time for each display cell is "1", a time for maintaining the potential of said second electrode at said first potential is 0.3 to 30.

7. A plasma display panel driving method claimed in claim 1 wherein the step of applying said voltage generating said space electric discharge, between said first electrode and said third electrode, includes the step of applying a displaying voltage pulse corresponding to a display data, to said third electrodes, while sequentially applying an addressing voltage pulse to said first electrodes, and the step of changing the potential of said second electrode to said second potential includes the step of applying a voltage pulse of said first potential to said second electrode in synchronism with or in advance to application of said addressing voltage pulse to said first electrode in the same display cell, and the step of changing and maintaining the potential of said second electrode to said second potential during a period in which said addressing voltage pulse is applied to said first electrode, or after said addressing voltage pulse is applied to said first electrode.

8. A plasma display panel driving method claimed in claim 7 wherein a pulse width of the voltage pulse applied to said second electrode is 0.5 to 50 microseconds.

9. A plasma display panel driving method claimed in claim 7 wherein a pulse width of the voltage pulse applied to said second electrode is 0.3 to 30 times the pulse width of said addressing voltage pulse.

10. A plasma display panel driving method claimed in claim 1 wherein the step of applying said voltage generating said space electric discharge, between said first electrode and said third electrode, includes the step of applying a displaying voltage pulse corresponding to a display data, to said third electrodes, while sequentially applying an addressing voltage pulse to said first electrodes, and the step of changing the potential of said second electrode to said second potential includes the step of applying to all said second electrodes, a voltage pulse of said first potential having a pulse width narrower than that of said addressing voltage pulse, in synchronism with application of each addressing voltage pulse, and the step of maintaining the potential of said second electrode at said second potential during a period in which said addressing voltage pulse is applied.

11. A plasma display panel driving method claimed in claim 10 wherein a pulse width of the voltage pulse applied to said second electrode is not less than 0.5 microseconds.

12. A plasma display panel driving method claimed in claim 10 wherein a pulse width of the voltage pulse applied to said second electrode is 0.3 to 0.8 times the pulse width of said addressing voltage pulse.

13. A plasma display panel driving method claimed in claim 1 wherein said plurality of second electrodes are divided into a first group and a second group which are connected to separate drive circuits, respectively, and wherein the step of applying said voltage generating said space electric discharge, between said first electrode and said third electrode, includes the step of applying a displaying voltage pulse corresponding to a display data, to said third electrodes, while sequentially applying an addressing voltage pulse to said first electrodes, and the step of changing the potential of said second electrode to said second potential includes the step of maintaining the potential of all said second electrodes included in said first group, at said first potential only during a time period shorter than the pulse width of said address voltage pulse, in synchronism with application of said addressing voltage pulse to the first electrode provided in the display cell including one electrode of said second electrodes included in said first group, while maintaining the potential of all said second electrodes included in said second group at said second potential during said time period, and the step of maintaining the potential of all said second electrodes included in said first group at said second potential during a second time period after said first mentioned time period of maintaining at said first potential, while maintaining the potential of all said second electrodes included in said second group at said first potential during said second time period, so that phase-inverted voltages are applied to the first group of second electrodes and the second group of second electrodes, respectively.

14. A plasma display panel driving method claimed in claim 13 wherein a time period for maintaining said second electrode at said first potential during the period in which said addressing voltage pulse is applied to said first electrode, is not less than 0.5 microseconds.

15. A plasma display panel driving method claimed in claim 14, further including the step of utilizing an electric power stored in a capacitance component of one group of said first group of second electrodes and said second group of second electrodes, for charging said second electrodes of the other group, in response to said voltage inversion.

16. A plasma display panel driving method claimed in claim 13 wherein a time period for maintaining said second electrode at said first potential during the period in which said addressing voltage pulse is applied to said first electrode, is not less 0.3 times the pulse width of said addressing voltage pulse.

17. A plasma display panel driving method claimed in claim 16, further including the step of utilizing an electric power stored in a capacitance component of one group of said first group of second electrodes and said second group of second electrodes, for charging said second electrodes of the other group, in response to said voltage inversion.

18. A plasma display panel driving method claimed in claim 13, further including the step of utilizing an electric power stored in a capacitance component of one group of said first group of second electrodes and said second group of second electrodes, for charging said second electrodes of the other group, in response to said voltage inversion.

* * * * *